US006969149B2

(12) United States Patent
Eguchi et al.

(10) Patent No.: US 6,969,149 B2
(45) Date of Patent: Nov. 29, 2005

(54) PRINT HEAD

(75) Inventors: Takeo Eguchi, Kanagawa (JP); Masayuki Takakura, Kanagawa (JP); Masato Nakamura, Kanagawa (JP); Shinichi Horii, Kanagawa (JP); Hiroyasu Uchida, Kanagawa (JP); Akihito Miyazaki, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/468,315

(22) PCT Filed: Dec. 13, 2002

(86) PCT No.: PCT/JP02/13086

§ 371 (c)(1),
(2), (4) Date: Aug. 15, 2003

(87) PCT Pub. No.: WO03/051637

PCT Pub. Date: Jun. 26, 2003

(65) Prior Publication Data

US 2004/0095422 A1 May 20, 2004

(30) Foreign Application Priority Data

Dec. 18, 2001 (JP) ..... 2001-385011
Dec. 18, 2001 (JP) ..... 2001-385213

(51) Int. Cl.[7] ..... B41J 2/14; B41J 2/16
(52) U.S. Cl. ..... 347/49
(58) Field of Search ..... 347/42, 49, 65, 347/67

(56) References Cited

U.S. PATENT DOCUMENTS 4,463,359 A * 7/1984 Ayata et al. ..... 347/56
6,315,403 B1 11/2001 Shinozaki
6,530,647 B2 * 3/2003 Kubota et al. ..... 347/43

FOREIGN PATENT DOCUMENTS

JP 2001-232781 A 8/2001
JP 2001-322292 A 11/2001

* cited by examiner

*Primary Examiner*—Thinh Nguyen
(74) *Attorney, Agent, or Firm*—Robert J. Depke; Trexler, Bushnell, Giangiorgi, Blackstone & Marr

(57) ABSTRACT

A print head for a line printer in which errors between print head chips and another component are reduced and ink leakage is prevented, and in which heat generated in print head chips is efficiently dissipated without making the structure of the print head complex or increasing the size of the print head. A plurality of print head chips (11) are arranged along an ink path (20) and are disposed on both sides of the ink path in a zigzag pattern. Dummy chips (21) which do not eject ink are disposed at regions between the print head chips (11) arranged along the ink path (20). In addition, an ink-path member (23) is provided, at least a part of the ink-path member (23) which includes portions adhered to the print head chips (11) being composed of a material having a high thermal conductivity, so that the ink-path member (23) also serves as heat-dissipating means which dissipates heat generated in the print head chips (11).

28 Claims, 22 Drawing Sheets

PRINT HEAD

This application claims priority to Japanese Patent Application Numbers JP2001-385213 filed Dec. 18, 2001, and JP2001-385011, filed Dec. 18, 2001, which are all incorporated herein by reference.

TECHNICAL FIELD

The present invention relates to a print head in which a plurality of print head chips are arranged, each print head chip having a plurality of ink-pressurizing cells arranged on a substrate, the ink-pressurizing cells having heating elements which are driven so as to eject ink contained in the ink-pressurizing cells through nozzles, and in particular, the present invention relates to a print head which does not cause ink leakage and a print head which exhibits an enhanced heat dissipation effect.

BACKGROUND ART

FIG. 21 is a schematic plan view of a print head 1 included in a known inkjet line printer.

In line printers, one line is simultaneously printed on a print medium. Accordingly, the print head 1 includes a plurality of print head chips 2 (2A, 2B, . . . ) which are arranged in a direction in which lines are printed. Although only five print head chips 2A to 2E are shown in FIG. 21, more print head chips 2 are actually arranged.

Although not shown in the figure, each print head chip 2 is constructed by, for example, disposing heating elements for heating ink on a semiconductor substrate, forming ink-pressurizing cells such that the ink-pressurizing cells surround their respective heating elements, and disposing a nozzle sheet having nozzles for ejecting ink drops above the heating elements. Ink contained in the ink-pressurizing cells is heated by rapidly heating the heating elements, and is ejected from the nozzles due to force applied by bubbles of ink vapor (ink bubbles).

In addition, the print head 1 is provided with an ink path 3 (region between the double-dotted chain lines in FIG. 21) which extends along the length of the print head 1. The ink path 3 is used for supplying ink to the ink-pressurizing cells of the print head chips 2. The print head chips 2 are arranged along the ink path 3 and are disposed on both sides of the ink path 3. In addition, the print head chips 2 on one side of the ink path 3 and the print head chips 2 on the other side face each other across the ink path 3. More specifically, the print head chips 2 on one side of the ink path 3 are rotated 180 degrees relative to the print head chips 2 on the other side. Accordingly, the ink-pressurizing cells of all of the print head chips 2 are communicating with the ink path 3.

In addition, in FIG. 21, the print head chips 2 are alternately disposed on the upper side and the lower side of the ink path 3 along the length of the ink path 3; that is, the print head chips 2 are arranged in a zigzag pattern.

More specifically, the print head chip 2A at the left end in FIG. 21 is placed on the upper side of the ink path 3, and the print head chip 2B, which is adjacent to the print head chip 2A, is placed on the lower side of the ink path 3 in FIG. 21. In addition, the print head chip 2C, which is adjacent to the print head chip 2B, is placed on the upper side of the ink path 3 in FIG. 21.

In addition, although not shown in the figure, the print head chips 2 are arranged such that if an interval between the adjacent nozzles in each print head chip 2 is L, an interval between the nozzles at the ends of the adjacent print head chips 2 (an interval in the direction in which the print head chips 2 are arranged) is also L. For example, in FIG. 21, an interval between the right end nozzle of the print head chip 2A and the left end nozzle of the print head chip 2B is L. Accordingly, even when ink is ejected from a plurality of print head chips 2, all ink drops land on the print medium at a constant interval L.

FIG. 22 is a sectional view of FIG. 21 cut along line A—A, and an ink-path member 4 placed on the print head chips 2 is also shown in FIG. 22. FIG. 23 is a sectional view of FIG. 21 cut along line B—B, and the ink-path member 4 is also shown in FIG. 23. FIG. 24 is a sectional view of FIG. 21 cut along line C—C, and the ink-path member 4 is also shown in FIG. 24.

As shown in FIGS. 22 to 24, the ink-path member 4 is placed on the top surfaces (surfaces facing the ink-path member 4) of the print head chips 2. The ink-path member 4 has a groove 4*a* (having a bracket shape in cross section) which extends along the length of the ink-path member 4 and which communicates with the ink path 3. In addition, the ink-path member 4 also has recesses 4*b* for receiving the print head chips 2 in the bottom surface thereof. The number of the recesses 4*b* provided is the same as the number of the print head chips 2, and the size of the recesses 4*b* is slightly larger than the size of the print head chips 2.

When the ink-path member 4 is placed on the print head chips 2, the groove 4*a* of the ink-path member 4 is positioned directly above the ink path 3 and the print head chips 2 are disposed in their respective recesses 4*b*. Then, the recesses 4*b* and the print head chips 2 are adhered to each other. The ink-path member 4 does not have the recesses 4*b* and is directly adhered to a nozzle sheet 5 at regions where the print head chips 2 are not disposed (see left side in FIG. 24). Accordingly, the spaces between the ink-path member 4 and the print head chips 2 and the spaces between the ink-path member 4 and the nozzle sheet 5 are sealed with an adhesive layer.

In the print head 1 which is constructed as described above, ink flows through the groove 4*a* of the ink-path member 4 and the ink path 3 and is supplied to the ink-pressurizing cells of each print head chip 2 without leaking out of the print head 1.

In the above-described known technique, there are certain limits to the processing accuracy of the print head chips 2, the positioning accuracy when the ink-path member 4 is adhered to the print head chips 2, and the processing accuracy of the recesses 4*b* of the ink-path member 4.

Accordingly, when the accuracy error exceeds a certain limit, there is a possibility that the spaces between the ink-path member 4 and the print head chips 2 cannot be completely sealed when the ink-path member 4 is adhered to the print head chips 2, and gaps will be generated between the ink-path member 4 and the print head chips 2. Accordingly, there is a risk in that ink will leak out of the print head 1 though these gaps.

FIGS. 25 and 26 are sectional views which correspond to FIGS. 22 and 24, respectively, showing the case in which the ink-path member 4 includes an error.

As shown in FIGS. 25 and 26, it is assumed that a surface 4*c* between the recesses 4*b* of the ink-path member 4 has an error and the amount of error of the surface 4*c* is X. In this case, when the ink-path member 4 is placed on the print head chips 2, the surface 4*c* of the ink-path member 4 first comes into contact with the nozzle sheet 5. At this time, the distances between the recesses 4*b* and the print head chips 2 are larger than the designed value by X, and gaps S are generated accordingly. Similarly, gaps S are also generated between the nozzle sheet 5 and the surfaces other than the surface 4*c* where the recesses 4*b* are not provided. If the gaps S are too large to be completely sealed with an adhesive, ink will leak out though the gaps S.

On the other hand, in the above-described known technique, heat is emitted from the print head chips when they are driven, that is, when the heating elements are heated, and there is a problem as to how the heat generated in the print head chips is to be dissipated.

A part of heat generated by the heating elements goes out along with ink when the ink is ejected, but the remaining heat accumulates in the print head chips. Accordingly, when ink is continuously ejected (when printing is continuously performed), a temperature increase of 100° C. or more occurs in a short time in the print head chips.

In particular, heat generation cannot be ignored in print heads for line printers since they include many print head chips and there are the same number of heat generators as the number of print head chips.

In order to properly eject ink, the operating temperature of the print head chips must not be higher than the boiling point of ink (approximately 100° C.). If the temperature exceeds this limit, a state in which a proper amount of ink is properly ejected cannot be obtained and the printing quality will be degraded.

Accordingly, a method is known in which when printing is performed for a predetermined time, the operation is stopped for a predetermined time interval to reduce the temperature before the operation is restarted. However, this method has a problem in that the overall print speed is reduced if the stopping time is increased to suppress the temperature increase.

Alternatively, a heat-dissipating member may be installed in the print head. However, in the case in which the heat-dissipating member is installed in the print head, sufficient ambient dissipation cannot be provided unless the surface area of the heat-dissipating member is large. Accordingly, there is a problem in that the size of the print head is increased if a large heat-dissipating member is installed. On the contrary, if the surface area of the heat-dissipating member is reduced, sufficient ambient dissipation cannot be provided.

In addition, print head chips are generally arranged in a zigzag pattern in known print heads for line printers, and it is difficult to accurately process the heat-dissipating member in accordance the arrangement of the print head chips and install it.

DISCLOSURE OF INVENTION

Accordingly, a first object of the present invention is to provide a print head for a line printer in which print head chips are arranged, wherein errors between the print head chips and another component are reduced and ink leakage is prevented without increasing the processing accuracy and the attachment accuracy of each component. In addition, a second object of the present invention is to provide a print head for a line printer in which print head chips are arranged, wherein heat generated in the print head chips is efficiently dissipated without making the structure complex or increasing the size of the print head.

The present invention achieves the above-described first object by the following means.

According to the present invention, a print head in which a plurality of print head chips are arranged, each print head chip having a plurality of ink-pressurizing cells arranged on a substrate, the ink-pressurizing cells having heating elements which are driven so as to eject ink contained in the ink-pressurizing cells through nozzles, includes an ink path which communicates with the ink-pressurizing cells of each print head chip and which is used for supplying ink to the ink-pressurizing cells. The print head chips are arranged along the ink path and are disposed on both sides of the ink path, and the print head chips on one side of the ink path and the print head chips on the other side face each other across the ink path. In addition, the print head chips are alternately disposed on one side and the other side of the ink path along the length of the ink path, and dummy chips which do not eject ink are disposed at regions between the print head chips arranged along the ink path where the print head chips are not disposed.

(Operation)

According to the present invention, a plurality of print head chips are arranged along the ink path in a zigzag pattern, and the dummy chips which do not eject ink are disposed at regions between the print head chips, that is, regions where the print head chips are not disposed.

Accordingly, the top surfaces of the print head chips and the dummy chips are even, and an adhesion surface between the print head chips and another component is approximately flat.

The present invention achieves the above-described second object by the following means.

According to the present invention, a print head in which a plurality of print head chips are arranged, each print head chip having a plurality of ink-pressurizing cells arranged on a substrate, the ink-pressurizing cells having heating elements which are driven so as to eject ink contained in the ink-pressurizing cells through nozzles, includes an ink path which communicates with the ink-pressurizing cells of each print head chip, which is used for supplying ink to the ink-pressurizing cells, and which extends in a direction in which the print head chips are arranged, and an ink-path member which has a groove communicating with the ink path and which is adhered to the print head chips so as to cover the ink path, at least a part of the ink-path member which includes portions adhered to the print head chips being composed of a material having a high thermal conductivity, whereby the ink-path member also serves as heat-dissipating means which dissipates heat generated in the print head chips.

(Operation)

According to the present invention, heat generated in the print head chips is transmitted to the ink-path member which is adhered to the print head chips. Then, since at least a part of the ink-path member is composed of a material having a high thermal conductivity, the heat generated in the print head chips rapidly dissipates from the print head chips.

In addition, since the ink-path member is continuously cooled due to the ink flow, the cooling effect can be enhanced compared to simple ambient dissipation.

BEST MODE FOR CARRYING OUT THE INVENTION

Embodiments of the present invention will be described below with reference to the accompanying drawings.

(First Embodiment)

A first embodiment achieves the above-described first object.

Figure 1:
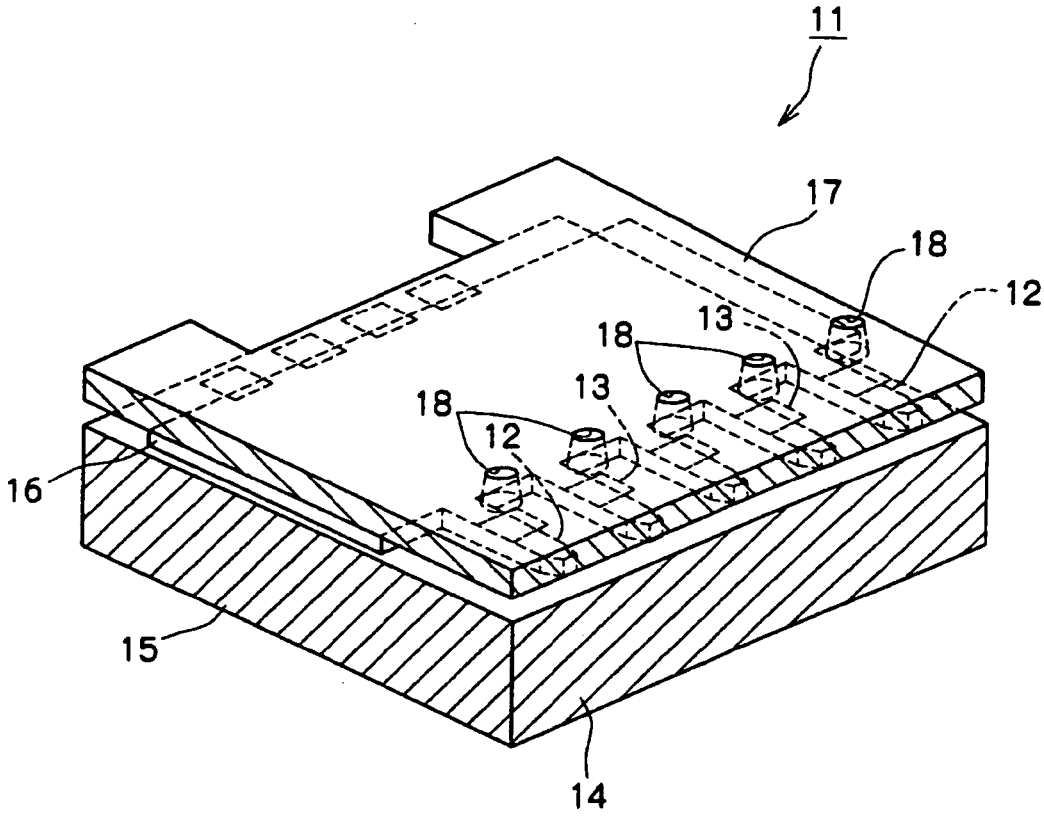
FIG. 1 is a perspective view showing a print head chip included in a print head according to the present invention.
Figure 2:
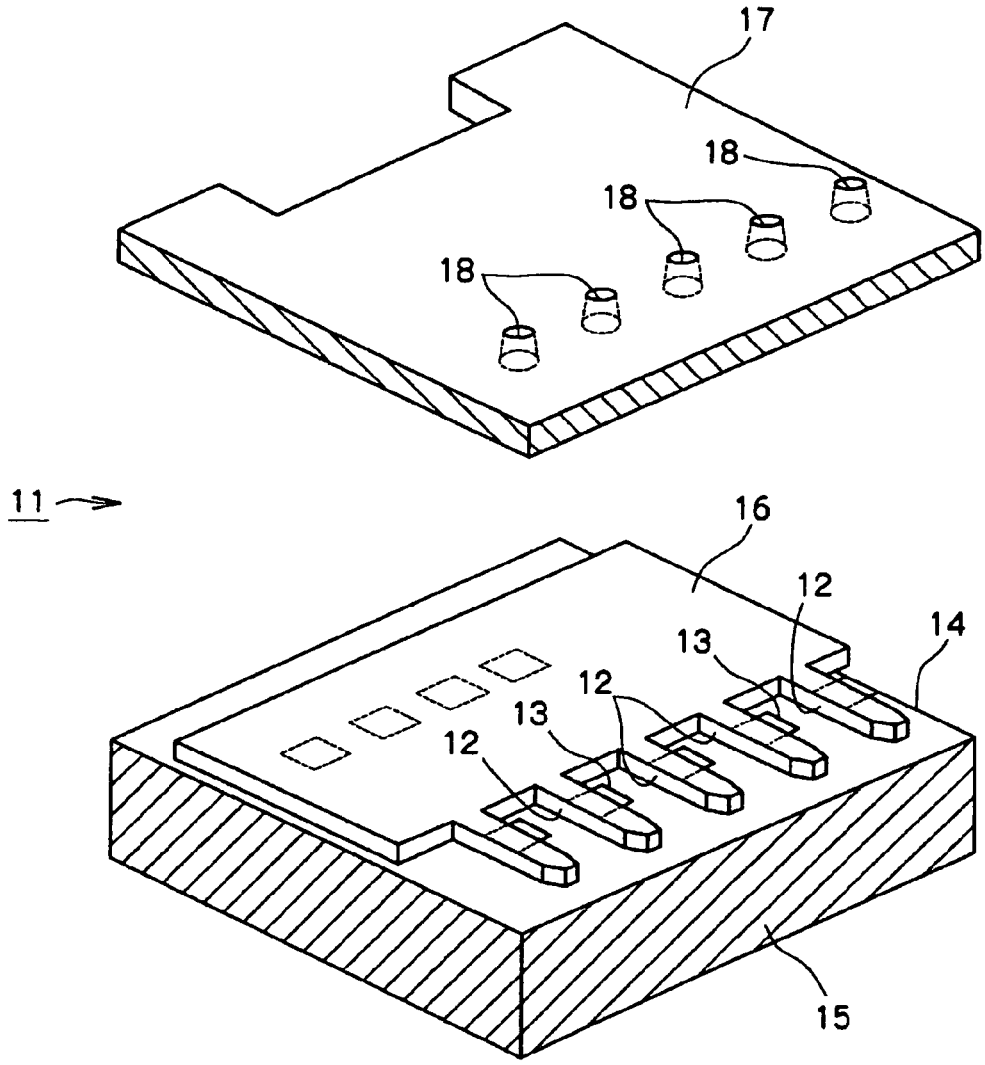
FIG. 2 is an exploded perspective view of FIG. 1 where a nozzle sheet is removed.

FIG. 1 is a perspective view showing a print head chip 11 included in a print head according to the present invention where a nozzle sheet 17 is adhered to the print head chip 11, and FIG. 2 is an exploded perspective view of FIG. 1 where the nozzle sheet 17 is removed.

In the print head chip 11, a base member 14 includes a semiconductor substrate 15 composed of silicon or the like and heating elements 13 formed on one side of the semiconductor substrate 15 by deposition. The heating elements 13 are electrically connected to an external circuit via conductors (not shown) formed on the semiconductor substrate 15.

A barrier layer 16 is composed of, for example, a light-curing dry film resist, and is constructed by laminating the dry film resist on the surface of the semiconductor substrate 15 on which the heating elements 13 are formed over the entire region thereof, and removing unnecessary parts by a photolithography process.

In addition, the nozzle sheet 17 has a plurality of nozzles 18 and is formed of, for example, nickel, by using an electroforming technique. The nozzle sheet 17 is laminated on the barrier layer 16 such that the nozzles 18 are positioned with respect to the heating elements 13, that is, such that the nozzles 18 face their respective heating elements 13. Although the nozzle sheet 17 is actually adhered to a plurality of print head chips 11, an enlarged view of a region in which the nozzle sheet 17 is adhered to a single print head chip 11 is shown in FIG. 1.

Ink-pressurizing cells 12 are constructed of the base member 14, the barrier layer 16, and the nozzle sheet 17, such that the ink-pressurizing cells 12 surround their respective heating elements 13. More specifically, in the figure, the base member 14 serves as the bottom walls of the ink-pressurizing cells 12, the barrier layer 16 serves as the side walls of the ink-pressurizing cells 12, and the nozzle sheet 17 serves as the top walls of the ink-pressurizing cells 12. Accordingly, the ink-pressurizing cells 12 are open at the right front sides thereof in FIGS. 1 and 2, and are communicating with an ink path, which will be described below, via the open sides thereof.

Normally, a single print head chip 11 includes hundreds of heating elements 13 and ink-pressurizing cells 12 containing the heating elements 13. The heating elements 13 are selectively driven in accordance with a command issued by a controller of a printer, and ink contained in the ink-pressurizing cells 12 corresponding to the selected heating elements 13 is ejected from the nozzles 18 which face the ink-pressurizing cells 12.

More specifically, in the print head chip 11, the ink-pressurizing cells 12 are filled with ink supplied via the ink path, which will be described below, from an ink tank (not shown) which is combined with the print head chip 11. When a current pulse is applied to one of the heating elements 13 for a short time such as 1 to 3 microseconds, the heating element 13 is rapidly heated, and a bubble of ink vapor (ink bubble) is generated on the surface of the heating element 13. Then, as the ink bubble expands, a certain volume of ink is pushed ahead, and the same volume of ink is ejected out from the corresponding nozzle 18 as an ink drop. The ink drop ejected from the nozzle 18 lands on a print medium such as a piece of paper, etc.

Next, a print head for a line printer according to the present embodiment will be described below. A print head for a line printer includes multiple print head chips which are identical to the above-described print head chip 11. Since one line is simultaneously printed on a print medium in line printers, a plurality of print head chips 11 are arranged in a direction in which lines are printed.

Figure 3:
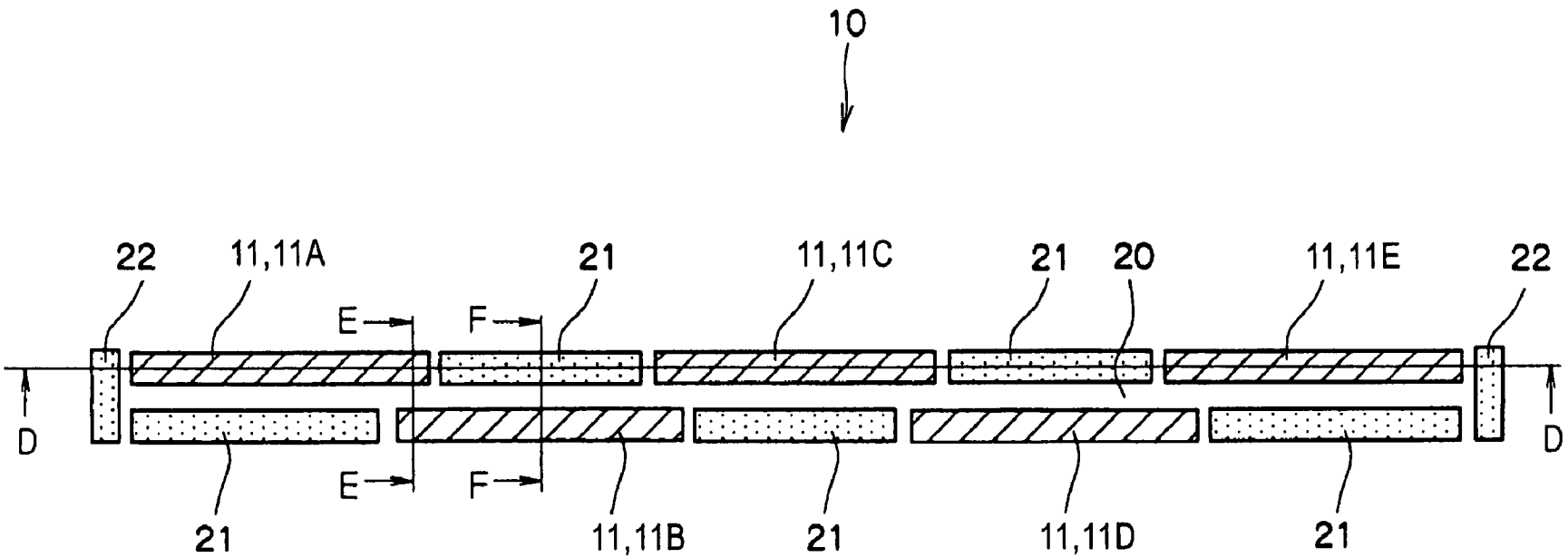
FIG. 3 is a plan view showing a print head according to a first embodiment.

FIG. 3 is a plan view showing a print head 10 according to the first embodiment. The print head 10 includes the print head chips 11 which are arranged along the length of the print head 10. Although only five print head chips 11 (11A to 11E) are shown in FIG. 3, more print head chips 11 are actually arranged.

The print head chips 11 are arranged along the length of the print head 10 (in the direction in which lines are printed) in a zigzag pattern. For example, in FIG. 3, the adjacent print head chips 11A and 11B are vertically shifted from each other by a predetermined distance. In addition, the print head chip 11C, which is adjacent to the print head chip 11B, and the print head chip 11A are aligned in the direction in which lines are printed.

Figure 4:
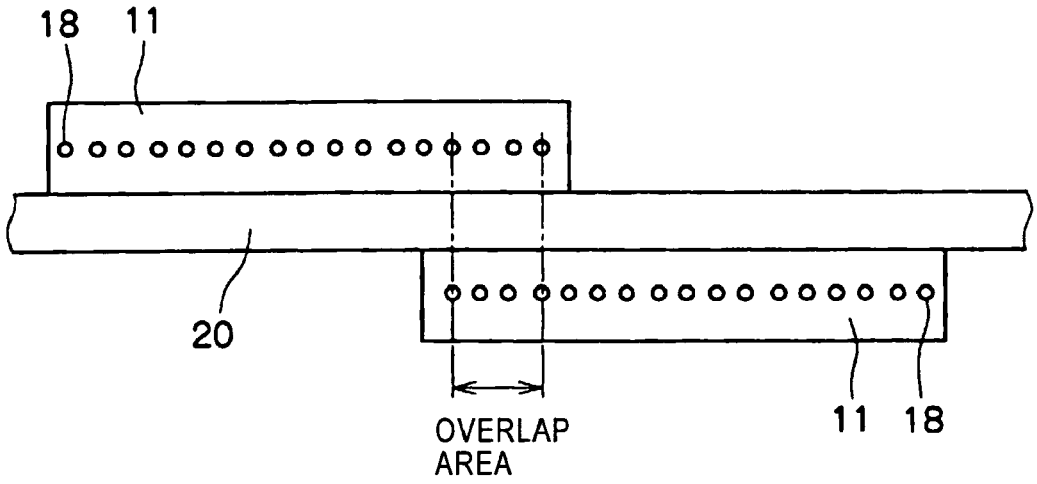
FIG. 4 is a plan view showing the manner in which the nozzles of the adjacent print head chips overlap.

Furthermore, the adjacent print head chips 11, for example, the print head chips 11A and 11B, are arranged such that they overlap each other by a plurality of nozzles 18 in the direction in which the print head chips 11 are arranged. FIG. 4 is a plan view showing the manner in which the nozzles 18 of the adjacent print head chips 11 overlap.

In the example shown in FIG. 4, four nozzles 18 from the right end of the print head chip 11 on the left and four nozzles 18 from the left end of the print head chip 11 on the right overlap in the longitudinal direction of the print head 10. When the print head chips 11 are arranged in this manner, even when there are differences in characteristics, for example, a difference in an ink-ejection angle, between the adjacent print head chips 11, ink drops ejected from the adjacent print head chips 11 can be mixed in the overlap area when printing is performed. Accordingly, the differences in characteristics between the adjacent print head chips 11 are relatively indiscernible and degradation of print quality can be prevented.

With reference to FIG. 3 again, an ink path 20 communicates with the ink-pressurizing cells 12 of each print head chip 11 and is used for supplying ink to the ink-pressurizing cells 12.

The print head chips 11 are arranged along the ink path 20 in a zigzag pattern across the ink path 20.

In addition, the print head chips 11 on one side of the ink path 20 and the print head chips 11 on the other side face each other across the ink path 20. More specifically, each print head chip 11 is orientated such that the open sides of the ink-pressurizing cells 12 (right front sides in FIGS. 1 and 2) face the ink path 20. Accordingly, each print head chip 11 is rotated 180 degrees relative to the print head chip 11 which is adjacent thereto. Thus, the ink-pressurizing cells 12 of all of the print head chips 11 are communicating with the ink path 20.

In addition, dummy chips 21 are disposed at regions between the print head chips 11 arranged along the ink path 20 where the print head chips 11 are not disposed. For example, in FIG. 3, the dummy chip 21 is disposed between the print head chips 11A and 11C.

Similar to the print head chips 11, each dummy chip 21 is also constructed by laminating the semiconductor substrate 15 and the barrier layer 16, and is adhered to the nozzle sheet 17 to which the print head chips 11 are adhered. The semiconductor substrate 15 and the barrier layer 16 of the dummy chips 21 are composed of the same materials and have the same thicknesses as the semiconductor substrate 15 and the barrier layer 16, respectively, of the print head chips 11. Accordingly, the dummy chips 21 and the print head chips 11 have the same thickness. However, the dummy chips 21 do not have the heating elements 13. In addition, although the barrier layer 16 is provided, it is not subjected to the photolithography process. Accordingly, the ink-pressurizing cells 12 are not formed. Therefore, although the dummy chips 21 are laminates having a similar construction as the print head chips 11, the dummy chips 21 do not eject ink.

Alternatively, the dummy chips 21 may also have exactly the same construction as the print head chips 11; that is, the heating elements 13 and the ink-pressurizing cells 12 may also be provided in the dummy chips 21. In such a case, the dummy chips 21 may be simply prevented from receiving electric signals (by, for example, not forming electric wires so that no electrical connection is provided).

In addition, the nozzle sheet 17 may have nozzles 18 at regions corresponding to the dummy chips 21, similar to the regions of the nozzle sheet 17 corresponding to the print head chips 11. However, it is not necessary to form the nozzles 18 at regions corresponding to the dummy chips 21.

In the present embodiment, the length of the dummy chips 21 is shorter than that of the print head chips 11. The reason for this is because since the print head chips 11 overlap each other as described above, the distances between the print head chips 11 disposed on the same side of the ink path 20, for example, the distance between the print head chips 11A and 11C, is shorter than the length of a single print head chip 11.

In addition, a dummy chip 22, which is similar to the dummy chips 21, is disposed at each end of the print head 10. The length of the dummy chips 22 is shorter than that of the dummy chips 21, but the construction of the dummy chips 22 is the same as that of the dummy chips 21. In addition, the thickness of the dummy chips 22 is the same as that of the dummy chips 21.

The dummy chips 22 are provided to close the ends of the ink path 20 of the print head 10, and are disposed such that the longitudinal direction of the dummy chips 22 is perpendicular to the longitudinal direction of the print head chips 11 and the dummy chips 21.

Accordingly, when the print head chips 11 and the dummy chips 21 and 22 are disposed, the ink path 20 is enclosed by the print head chips 11 and the dummy chips 21 and 22.

In addition, since the print head chips 11 and the dummy chips 21 and 22 have the same thickness, the top surfaces of the print head chips 11 and the dummy chips 21 and 22, which enclose the ink path 20, are even.

Figure 5:
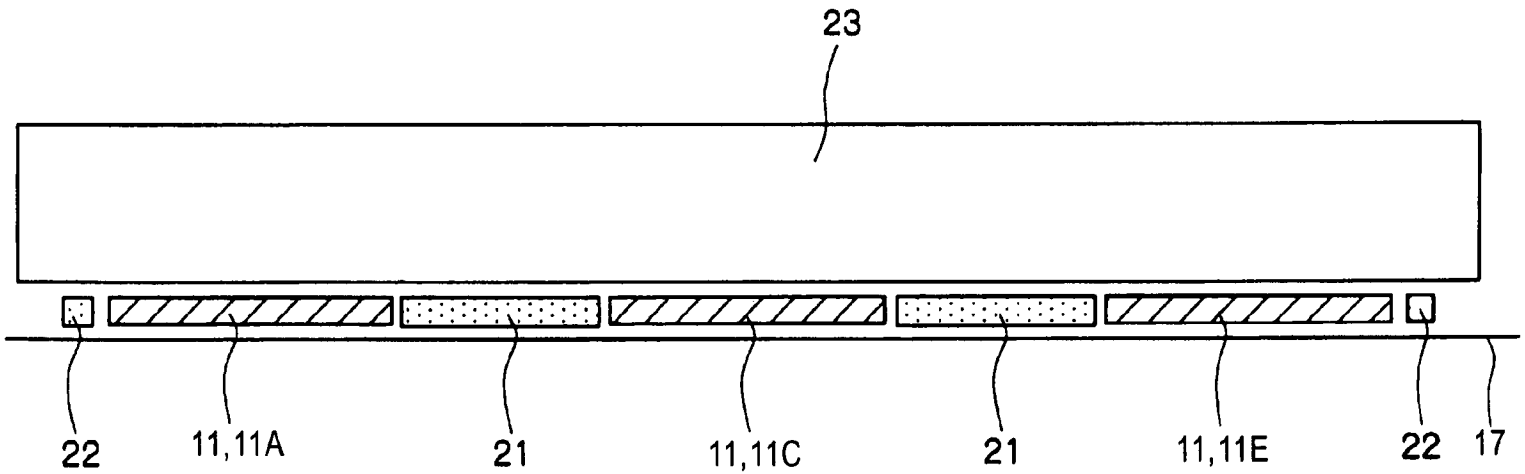
FIG. 5 is a sectional view of FIG. 3 cut along line D—D, and an ink-path member placed on print head chips and dummy chips is also shown in FIG. 5.
Figure 6:
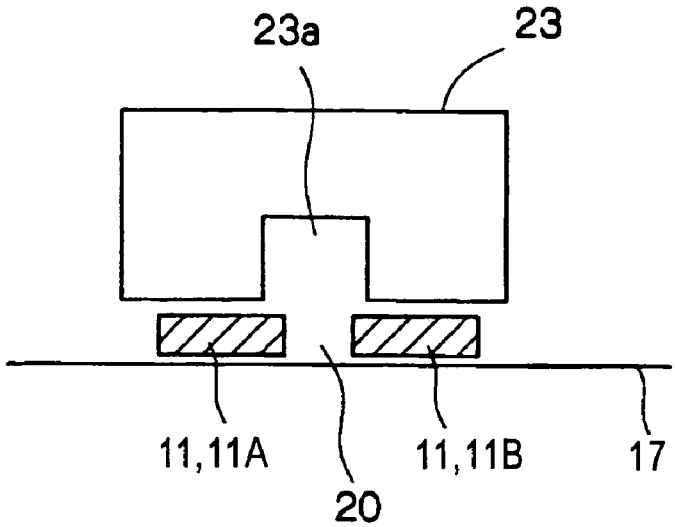
FIG. 6 is a sectional view of FIG. 3 cut along line E—E, and the ink-path member is also shown in FIG. 6.
Figure 7:
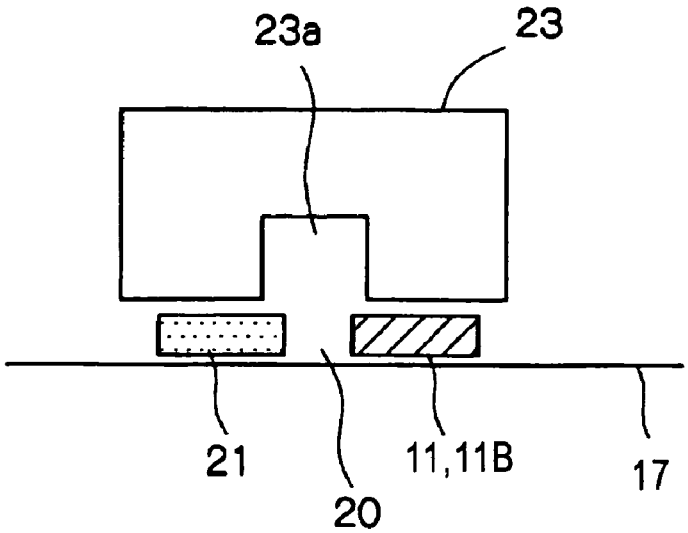
FIG. 7 is a sectional view of FIG. 3 cut along ling F—F, and the ink-path member is also shown in FIG. 7.

FIG. 5 is a sectional view of FIG. 3 cut along line D—D, and an ink-path member 23 placed on the print head chips 11 and the dummy chips 21 and 22 is also shown in FIG. 5. FIG. 6 is a sectional view of FIG. 3 cut along line E—E, and the ink-path member 23 is also shown in FIG. 6. FIG. 7 is a sectional view of FIG. 3 cut along ling F—F, and the ink-path member 23 is also shown in FIG. 7.

The ink-path member 23 has a groove 23*a* which communicates with the ink path 20, and is adhered to the top surfaces of the print head chips 11 and the dummy chips 21 and 22 (surfaces facing the ink-path member 23 in FIGS. 5, 6, and 7). Since the top surfaces of the print head chips 11 and the dummy chips 21 and 22 are even, the bottom surface of the ink-path member 23, which is adhered to the top surfaces of the print head chips 11 and the dummy chips 21 and 22, is flat. Accordingly, the adhesion surface of the ink-path member 23 can be easily processed and the processing accuracy can be improved.

The ink-path member 23 is disposed so as to cover the regions where the print head chips 11 and the dummy chips 21 and 22 are disposed. The ink-path member 23 has a groove 23*a* having a bracket shape in cross section in a surface thereof which faces the print head chips 11, etc., and is disposed such that the groove 23*a* faces the ink path 20. Accordingly, the groove 23*a* and the ink path 20 are communicating with each other.

In FIGS. 5 to 7, the bottom surface of the ink-path member 23 is adhered to the top surfaces of the print head chips 11 and the dummy chips 21 and 22 with an adhesive (for example, a silicone resin adhesive). Thus, an adhesive layer is provided between the adhesion surfaces so as to seal the spaces therebetween. Therefore, the ink which flows in the groove 23*a* of the ink-path member 23 and the ink path 20 does not leak out.

The case is considered in which the design value of the gap size between the print head chips 11 and the dummy chips 21 is 0.05 mm, the dimensional error in the length of the print head chips 11 and the dummy chips 21 is ±0.01 mm, and the assembly error (attachment position error of the print head chips 11 and the dummy chips 21) is ±0.02 mm. In this case, the distance between the print head chips 11 and the dummy chips 21 is 0 mm at minimum and +0.1 mm at maximum. Accordingly, if an adhesive which can fill a +0.1 mm gap is used, the gaps can always be filled as long as the error is within the range of the manufacturing error.

In addition, it is only necessary to form the groove 23*a,* which has the bracket shape in cross section, in the adhesion surface of the ink-path member 23 and it is not necessary to form recesses for receiving the print head chips 11 as in the known print head, so that high dimensional accuracy can be maintained. More specifically, since the dummy chips 21 and 22 are disposed at regions where the print head chips 11 are not disposed, processing of the adhesion surface of the ink-path member 23 can be made simpler and the dimensional accuracy can be improved accordingly.

(Second Embodiment)

A second embodiment achieves the above-described first object.

Figure 8:
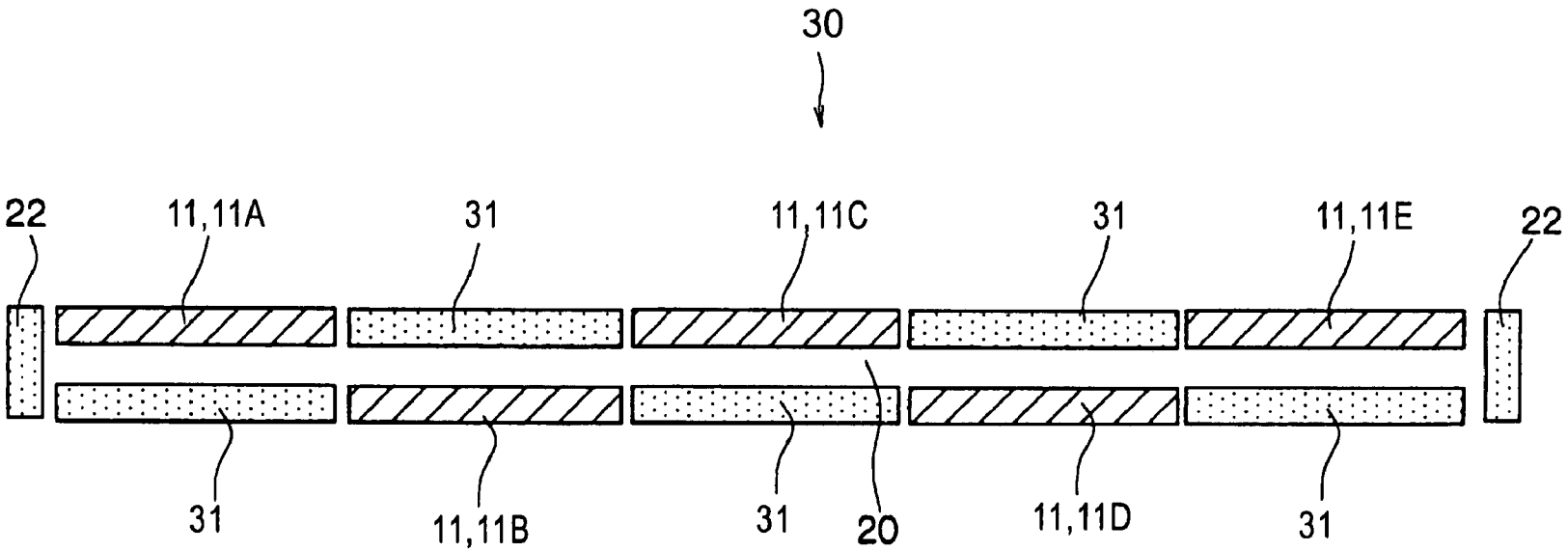
FIG. 8 is a plan view showing a print head according to a second embodiment of the present invention, which corresponds to FIG. 3 of the first embodiment.

FIG. 8 is a plan view of a print head 30 according to the second embodiment of the present invention, which corresponds to FIG. 3 of the first embodiment.

In the print head 30 of the second embodiment, similar to the above-described known print head, the print head chips 11 are arranged in a zigzag pattern (alternately) across the ink path 20, but do not overlap each other as in the first embodiment.

When the print head chips 11 are arranged in this manner, the length of the dummy chips 31 is the same as that of the print head chips 11. Accordingly, the print head chips 11 which are free from the heating elements 13, for example, may be used as the dummy chips 31.

Other constructions are similar to those of the first embodiment, and explanations thereof are thus omitted.

(Third Embodiment)

A third embodiment achieves the above-described first object.

Figure 9:
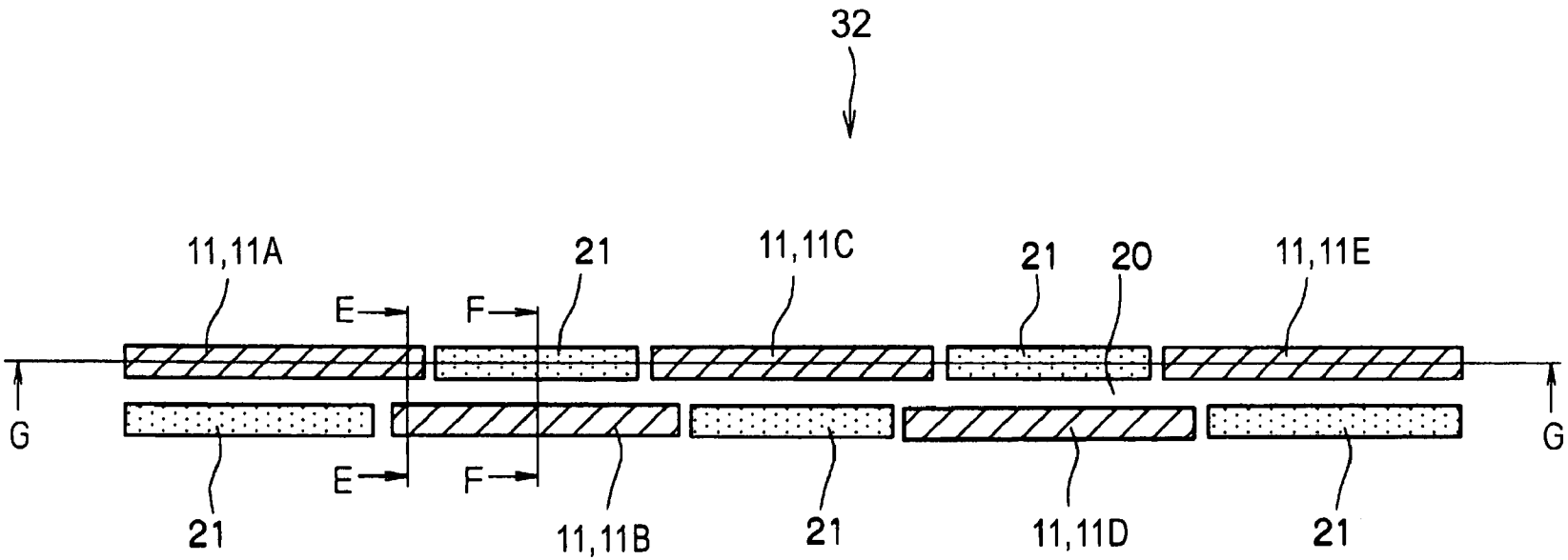
FIG. 9 is a plan view showing a print head according to a third embodiment of the present invention, which corresponds to FIG. 3 of the first embodiment.
Figure 10:
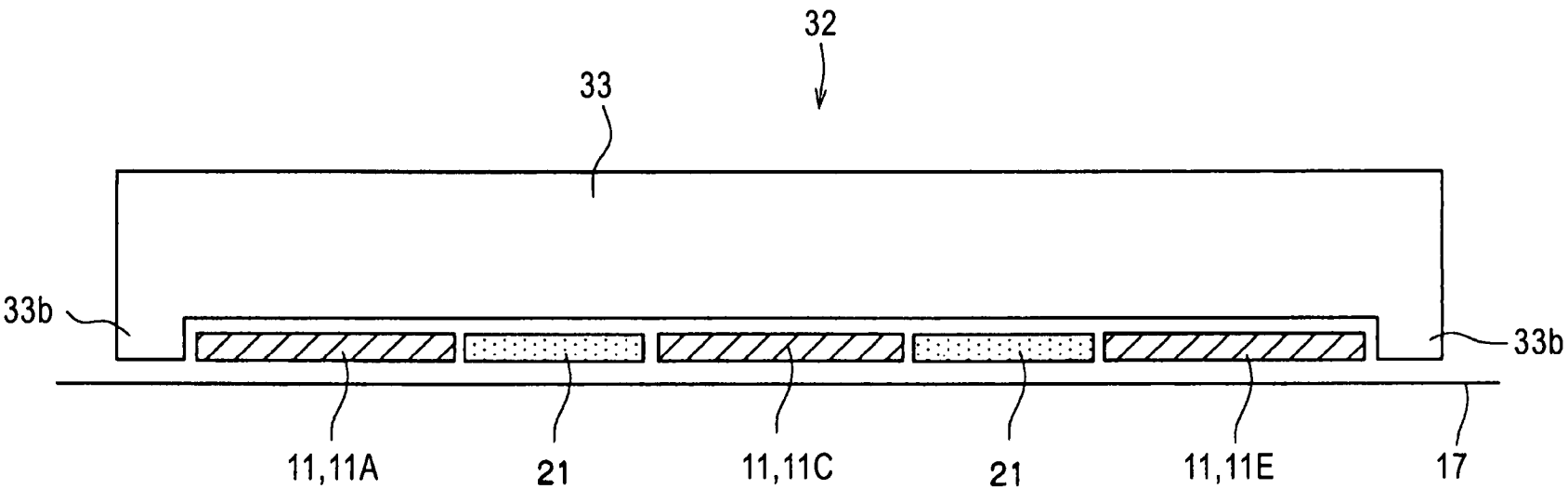
FIG. 10 is a sectional view of FIG. 9 cut along line G—G, and an ink-path member is also shown in FIG. 10.

FIG. 9 is a plan view showing a print head 32 according to a third embodiment of the present invention, which corresponds to FIG. 3 of the first embodiment. FIG. 10 is a sectional view of FIG. 9 cut along line G—G, and an ink-path member 33 is also shown in FIG. 10.

The print head 32 of the third embodiment differs from that of the first embodiment in that the dummy chips 22 are not provided at both ends thereof.

In the third embodiment, both ends of the ink path 20 are closed by the ink-path member 33. Accordingly, different from the ink-path member 23 of the first embodiment, the ink-path member 33 has a projection 33*b* at each end thereof. The projections 33*b* are directly adhered to the nozzle sheet 17.

When the ink-path member 33 is constructed as described above, the shape thereof is more complex than that of the first embodiment since the projections 33*b* must be provided at both ends thereof. However, since it is not necessary to provide the recesses for receiving the print head chips 11 as in the known print head, the processing accuracy can be more easily maintained compared to the ink-path member 4 of the known print head.

According to the present invention, the dummy chips are disposed at regions where the print head chips are not disposed, so that the surface roughness is reduced, and the adhesion surface between the print head chips and another component is approximately flat. Accordingly, errors between the print head chips and another component can be reduced. As a result, the print head chips can be reliably adhered to another component and ink leakage can be prevented, so that the above-described first object can be achieved.

Although the embodiments of a first invention of the present application has been described, the present invention is not limited to the above-described embodiments. For example, the following modifications are possible.

In the above-described embodiments, the print head chips 11 and the dummy chips 21 are disposed on both sides of the ink path 20. However, the construction may also be such that two ink paths 20A and 20B are provided with a predetermined gap therebetween and the print head chips 11 are arranged in two rows in a zigzag pattern at the region between the two ink paths 20A and 20B. In such a case, the print head chips 11 of one of the two rows receive ink from the ink path 20A, and the print head chips 11 of the other row may receive ink from the ink path 20B. Also in this case, the dummy chips 21 can be disposed between the print head chips 11, and the effects of the present invention can be obtained.

In addition, the effects of the present invention can also be obtained, by disposing the dummy chips at regions where the print head chips 11 are not disposed, in print heads having constructions other than those described above as long as the print heads include print head chips 11 which are arranged on the nozzle sheet 17. This is clearly understood from the effects provided by the dummy chips 22.

Next, a second invention of the present application for achieving the above-described second object will be described below. As disclosed in the following embodiments, not only the first object but also the second object can be achieved by applying the second invention in addition to the first invention of the present application.

Embodiments of the second invention of the present application will be described below with reference to the accompanying drawings.

(Fourth Embodiment)

Constructions of a fourth embodiment are similar to those of the first embodiment except for the points described below. Accordingly, in the description of the fourth embodiment, explanations of the constructions common with the first embodiment are omitted, and components similar to those of the first embodiment are denoted by the same reference numerals.

In the fourth embodiment, an ink-path member is different from that of the first embodiment, and an ink-path member 34 is used in place of the ink-path member 23. In addition, in the fourth embodiment, the ink-path member 34 is composed of aluminum or a material containing aluminum (for example, an aluminum alloy). This is because aluminum has a high thermal conductivity. More specifically, according to the present invention, the ink-path member 34 is composed of a material having a high thermal conductivity, so that the ink-path member 34 also serves as heat-dissipating means which dissipates heat generated by the heating elements 13 of the print head chips 11.

In the print head 10 which is constructed as described above, the print head chips 11 emit heat due to heat applied by the heating elements 13 when printing is performed. However, since the ink-path member 34 adhered to the print head chips 11 has a high thermal conductivity, heat generated in the print head chips 11 is quickly transmitted to the ink-path member 34 and is dissipated from the surface of the ink-path member 34.

When ink drops are ejected from the nozzles 18 of the print head chips 11, the ink-pressurizing cells 12 are refilled with ink supplied from the ink tank (not shown). At this time, the ink passes through a groove 34*a* of the ink-path member 34. Accordingly, the groove 34*a* of the ink-path member 34 is always filled with ink and the ink flows through the groove 34*a,* so that the ink-path member 34 is also cooled with the ink. Therefore, the heat dissipation effect provided by the ink-path member 34 can be further enhanced.

Figure 11:
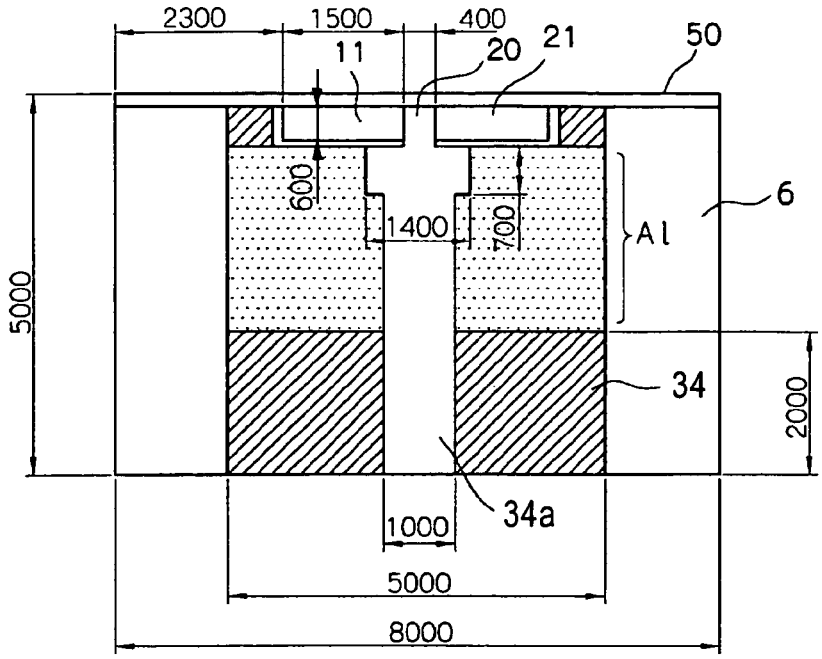
FIG. 11 is a sectional view showing the concrete shape of the print head chip according to the present invention.
Figure 12:
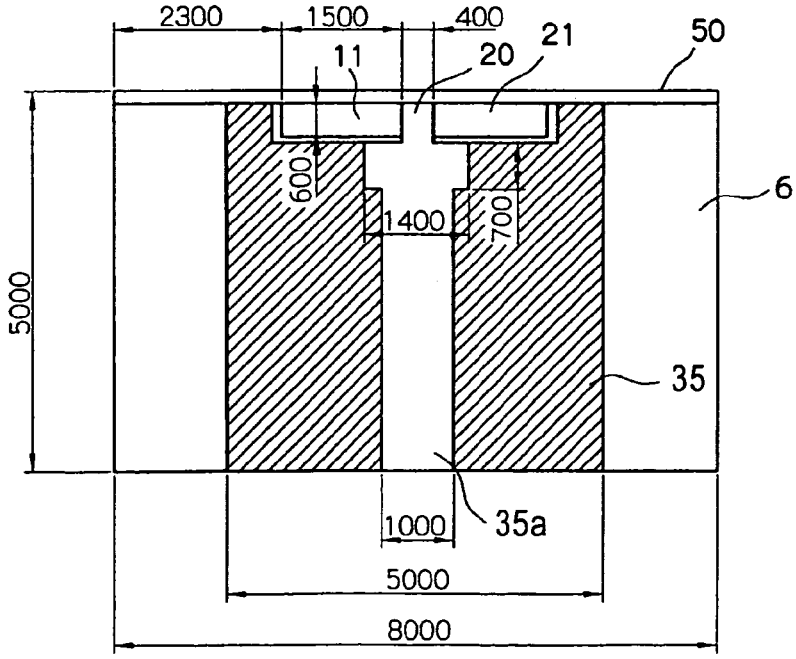
FIG. 12 is a sectional view showing the case in which the ink-path member has the same shape as that shown in FIG. 11 but is composed of a different material.

Next, an example in which the temperature change in the print head chips 11 is calculated will be described below. FIG. 11 is a sectional view showing the concrete shape of the print head 10 according to the present invention. FIG. 12 is a sectional view showing the case in which the ink-path member 34 has the same shape as that shown in FIG. 11 but is composed of a different material. The dimensional unit of the values shown in FIGS. 11 and 12 is the micrometer.

In FIGS. 11 and 12, the print head chip 11 and the dummy chip 21 are adhered to a nozzle sheet 50 composed of, for example, an epoxy resin, and the ink-path member 34 (FIG. 11) or an ink-path member 35 (FIG. 12) is adhered to the print head chip 11 and the dummy chip 21. In addition, a head frame 6 composed of alumina is disposed so as to surround the ink-path member 34 or 35.

In FIGS. 11 and 12, shaded portions of the ink-path member 34 or 35 are composed of a glass/epoxy composite. In addition, dotted portions (shown by "Al" in FIG. 11) are composed of aluminum.

More specifically, approximately half of the ink-path member 34 shown in FIG. 11 including portions adhered to the print head chip 11 and the dummy chip 21 is composed of aluminum, and the remaining half is composed of a glass/epoxy composite.

On the contrary, the entire body of the ink-path member 35 shown in FIG. 12 is composed of a glass/epoxy composite.

In the above-described construction, the temperature change in the print head chips 11 is calculated under the following conditions:

(1) Heat generation of the print head chips 11 (total) is 1.2 [W]×1.5 [$\mu$s]×9.6 [KHz].

(2) Heat dissipation by ink ejection is 3 [pl]×4.2 (specific heat of ink)×$\Delta$T (temperature increase)×9.6 [KHz].

(3) Heat dissipation from the surface due to natural convection of air is calculated based on a thermal conductivity of 10 [W/m$^2$K].

(4) Overall initial temperature is 0° C. (the ambient air is always 0° C.).

Figure 13:
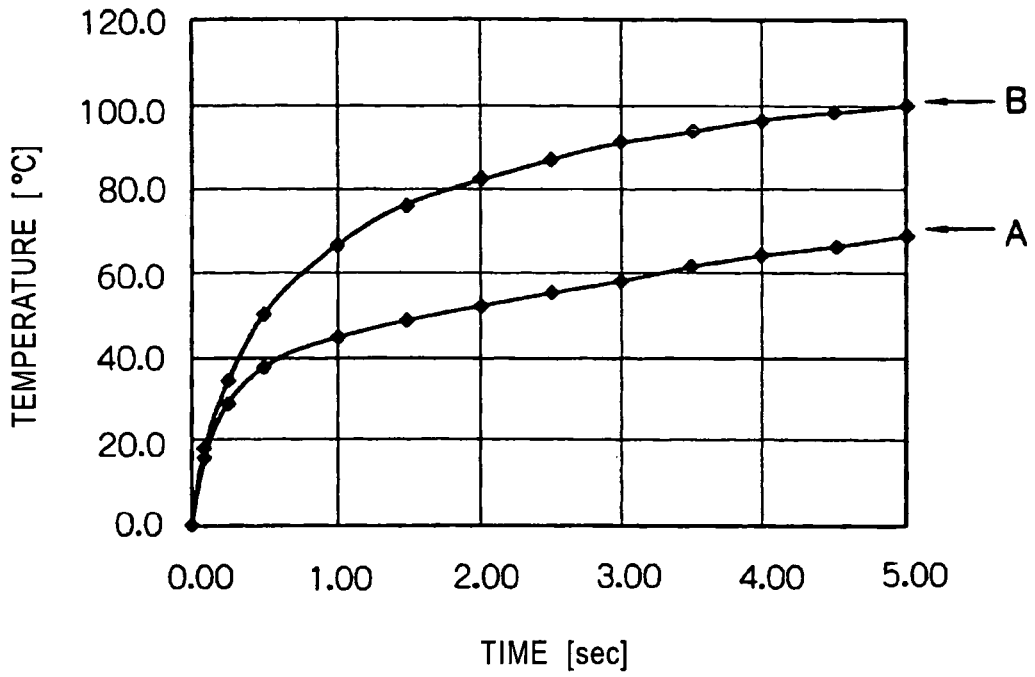
FIG. 13 is a graph showing the relationship between the elapsed time and the temperature increase in the print head chips shown in FIGS. 11 and 12.

FIG. 13 is a graph showing the relationship between the elapsed time and the temperature increase in the print head chips 11 under the above conditions. In FIG. 13, "A" corresponds to the construction shown in FIG. 11, and "B" corresponds to the construction shown in FIG. 12.

With reference to FIG. 13, although the temperature of "B" (FIG. 12) reaches approximately 100° C. in five seconds, the temperature of "A" (FIG. 11) after five seconds is approximately 70° C. From this result, it is understood that the temperature increase in the print head chips 11 can be suppressed when a part of the ink-path member 34 which includes portions adhered to the print head chips 11 is composed of aluminum.

Thus, according to the fourth embodiment, the temperature increase in the print head chips 11 can be suppressed while the processing accuracy of the ink-path member 34, that is, the dimensional accuracy of the print head chips 11, the dummy chips 21 and 22, and the gap between the nozzle sheet 17 and the ink-path member 34, is increased and ink leakage is prevented.

(Fifth Embodiment)

A fifth embodiment achieves the above-described second object.

Figure 14:
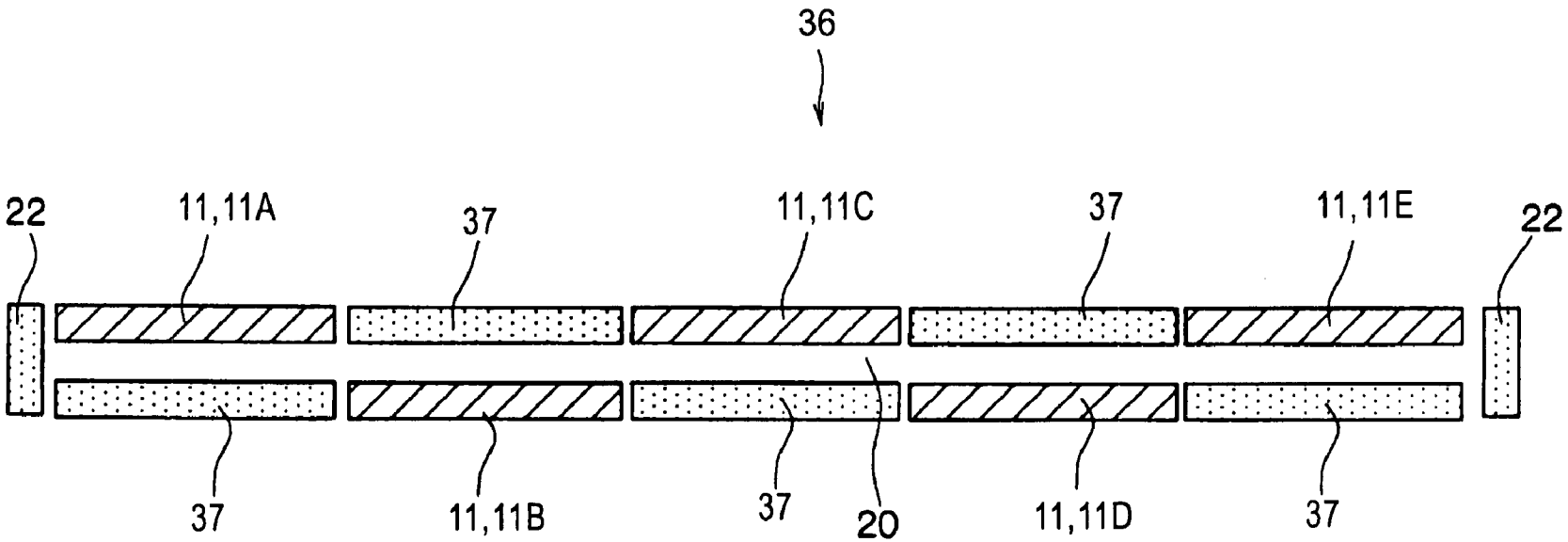
FIG. 14 is a plan view showing a print head according to a fifth embodiment of the present invention, which corresponds to FIG. 3 of the first embodiment.

FIG. 14 is a plan view of a print head 36 according to a fifth embodiment of the present invention, which corresponds to FIG. 3 of the first embodiment.

In the print head 36 of the fifth embodiment, similar to the fourth embodiment, the print head chips 11 are arranged in a zigzag pattern (alternately) across the ink path 20. However, the print head chips 11 do not overlap each other as in the fourth embodiment.

In addition, the print head chips 11 are arranged such that if an interval between the adjacent nozzles in each print head chip 11 is L, an interval between the nozzles at the ends of the adjacent print head chips 11 is also L. More specifically, in FIG. 14, an interval between the right end nozzle of the print head chip 11A and the left end nozzle of the print head chip 11B (an interval in the direction in which the print head chips 11 are arranged) is L.

Accordingly, even when ink is ejected from a plurality of print head chips 11, all ink drops land on the print medium at a constant interval L.

When the print head chips 11 are arranged in this manner, the length of dummy chips 37 is the same as that of the print head chips 11. Accordingly, the print head chips 11 which are free from the heating elements 13, for example, may be used as the dummy chips 37.

Other constructions are similar to those of the fourth embodiment, and explanations thereof are thus omitted.

(Sixth Embodiment)

Figure 15:
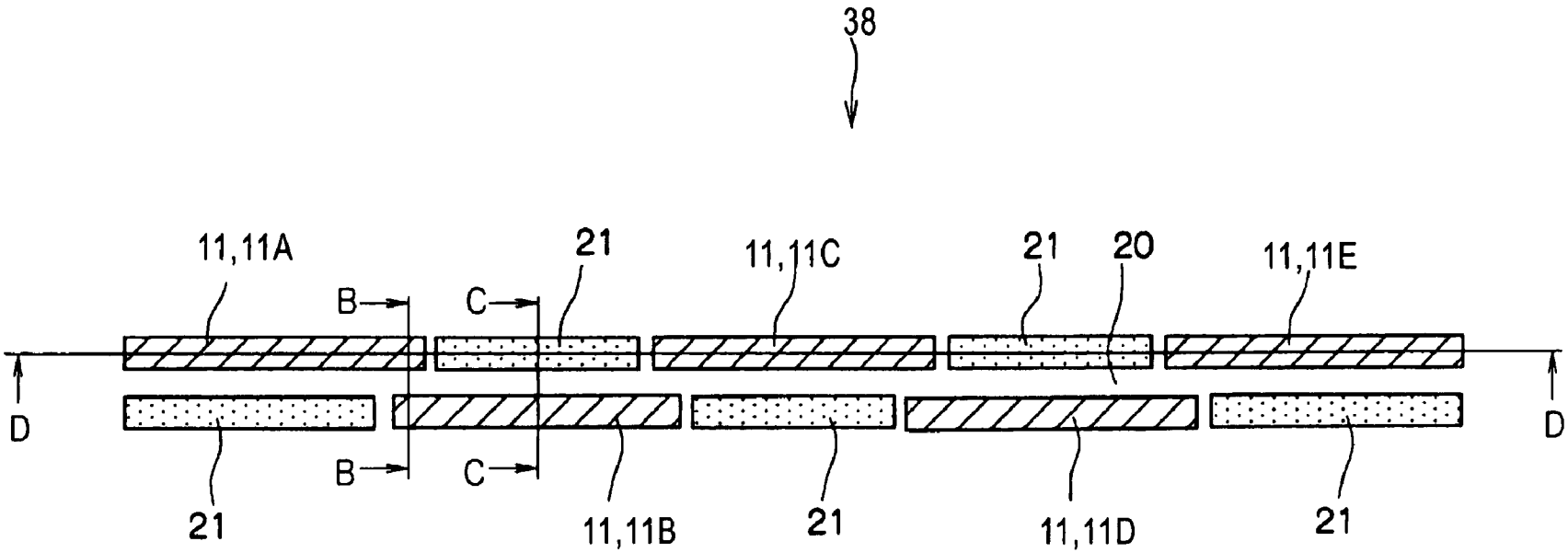
FIG. 15 is a plan view showing a print head according to a sixth embodiment of the present invention, which corresponds to FIG. 3 of the first embodiment.
Figure 16:
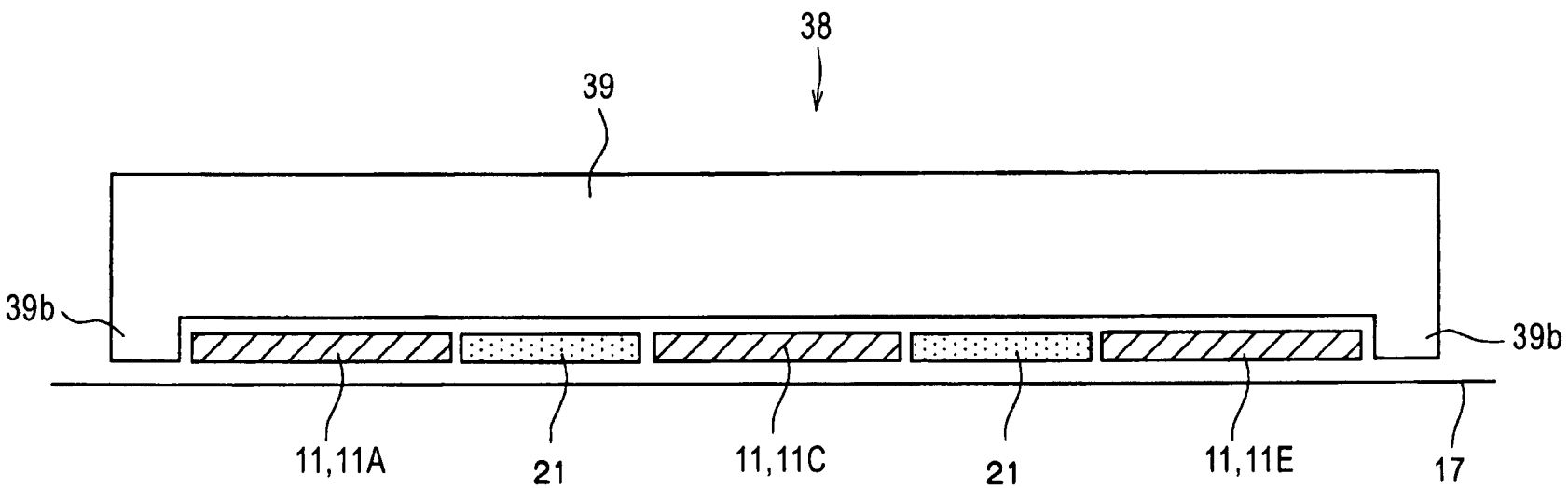
FIG. 16 is a sectional view of FIG. 15 cut along line D—D, and an ink-path member is also shown in FIG. 16.

FIG. 15 is a plan view showing a print head 38 according to a sixth embodiment of the present invention, which corresponds to FIG. 3 of the first embodiment. FIG. 16 is a sectional view of FIG. 15 cut along line D—D, and an ink-path member 39 is also shown in FIG. 16.

The print head 38 of the sixth embodiment differs from that of the fourth embodiment in that the dummy chips 22 are not provided at both ends thereof.

In the sixth embodiment, both ends of the ink path 20 are closed by the ink-path member 39. Accordingly, different from the ink-path member 34 of the fourth embodiment, the ink-path member 39 has a projection 39*b* at each end thereof. The projections 39*b* are directly adhered to the nozzle sheet 17. In this case, the projections 39*b* provided at both ends of the ink-path member 39 close the ends of the ink path 20, so that it is not necessary to dispose the dummy chips 22 as in the fourth embodiment.

Similar to the fourth embodiment, sectional views of FIG. 15 cut along lines B—B and C—C are similar to FIGS. 6 and 7, respectively, described in the first embodiment, and explanations thereof are thus omitted.

(Seventh Embodiment)

In a seventh embodiment the second invention of the present application is applied to the known technique in order to achieve the above-described second object. Accordingly, the second invention of the present application can also be applied to the known technique.

Figure 17:
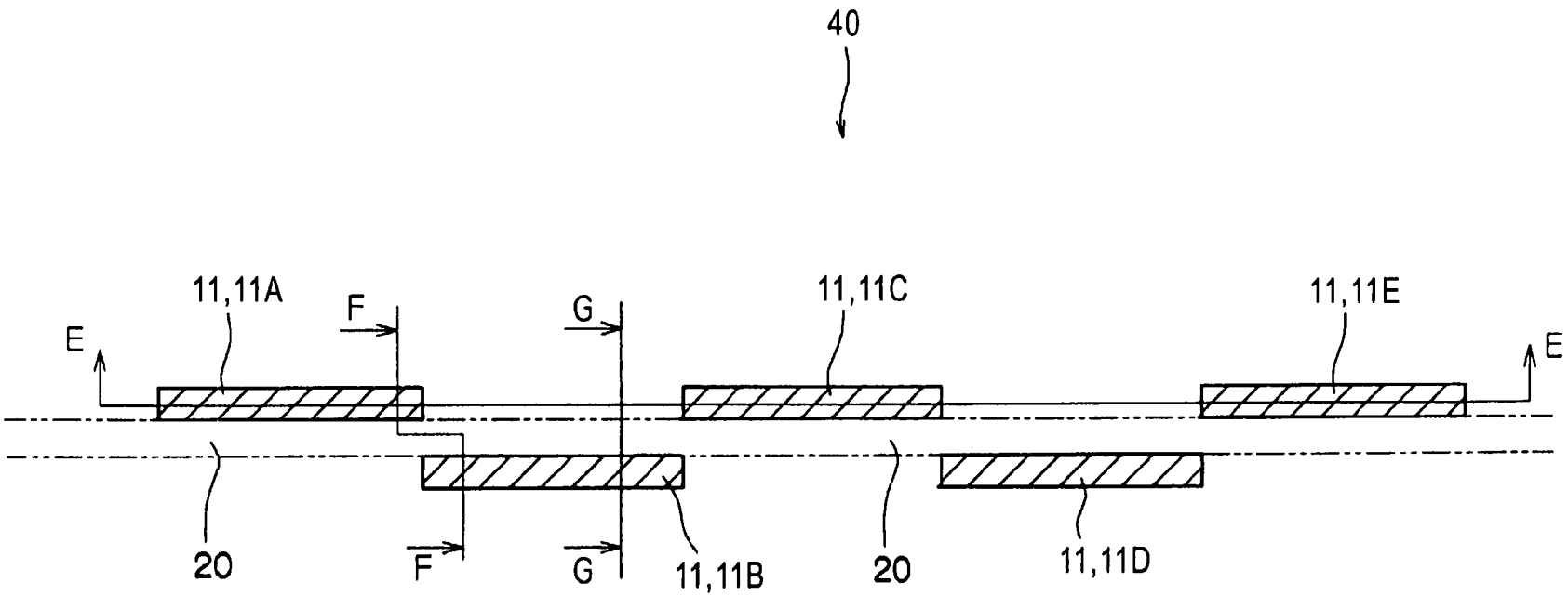
FIG. 17 is a plan view showing a print head according to a seventh embodiment of the present invention, which corresponds to FIG. 3 of the first embodiment.
Figure 18:
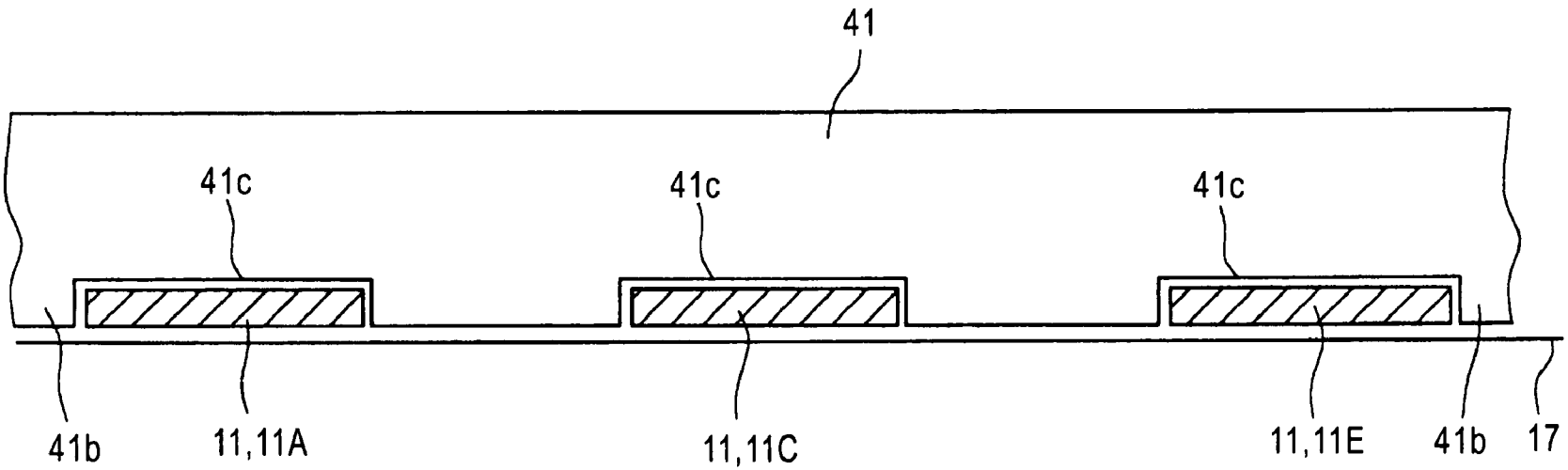
FIG. 18 is a sectional view of FIG. 17 cut along line E—E, and an ink-path member is also shown in FIG. 18.
Figure 19:
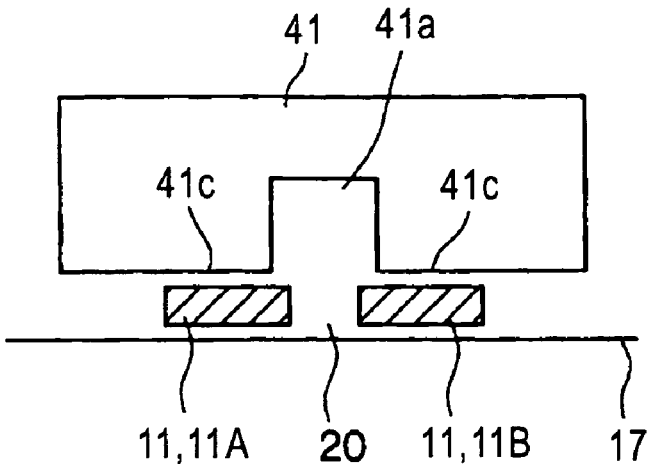
FIG. 19 is a sectional view of FIG. 17 cut along line F—F, and the ink-path member is also shown in FIG. 19.
Figure 20:
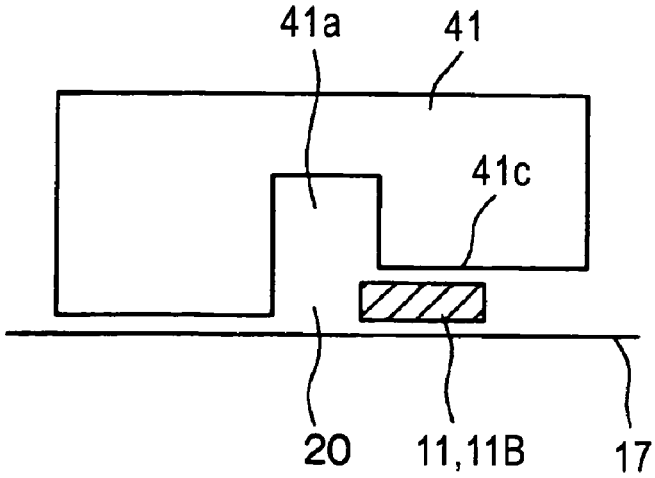
FIG. 20 is a sectional view of FIG. 17 cut along line G–G, and the ink-path member is also shown in FIG. 20.
Figure 21:
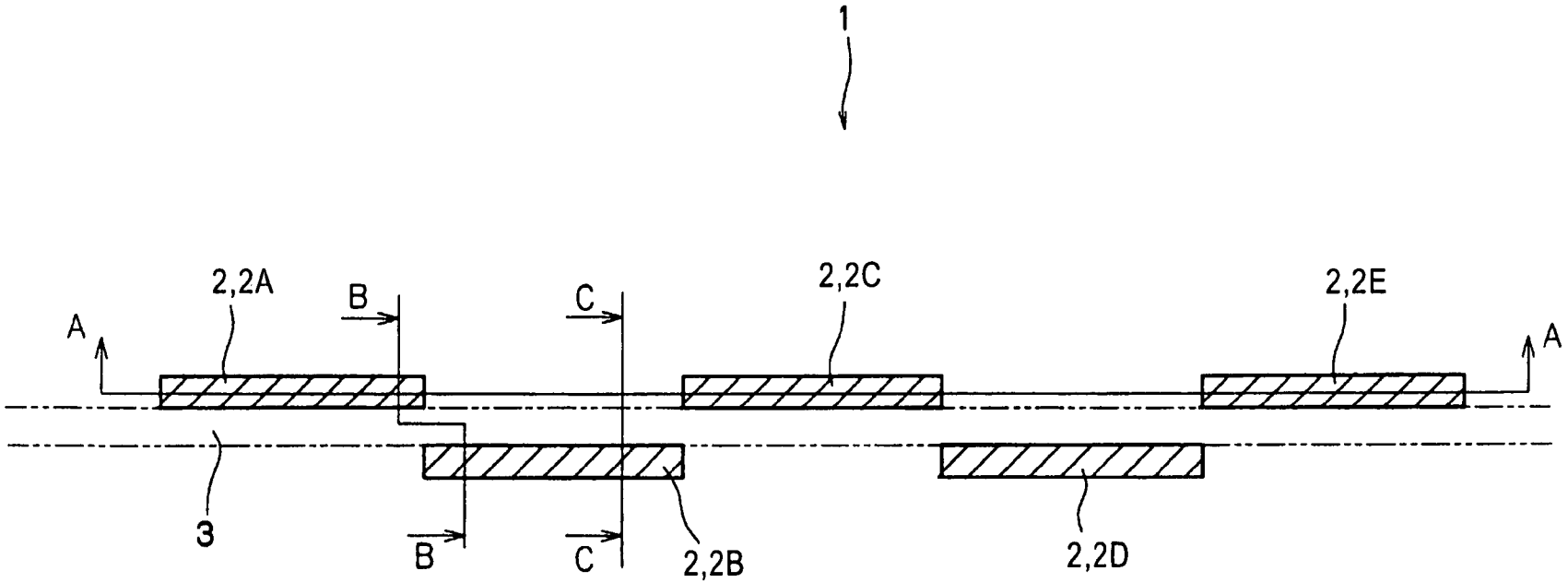
FIG. 21 is a schematic plan view of a print head included in a known inkjet line printer.
Figure 22:
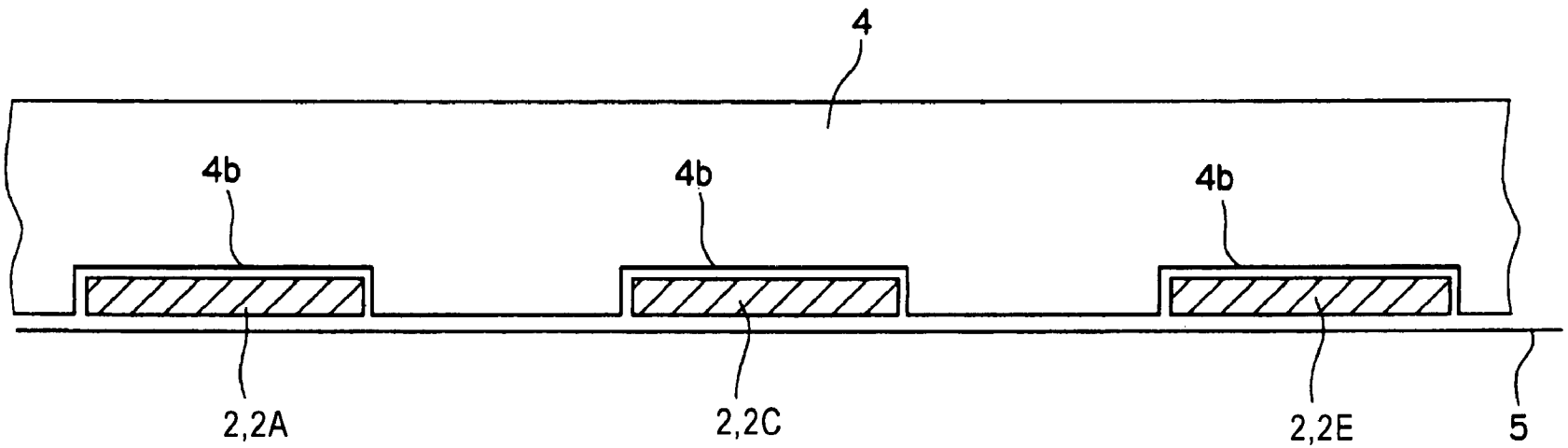
FIG. 22 is a sectional view of FIG. 21 cut along line A—A, and an ink-path member placed on print head chips is also shown in FIG. 22.
Figure 23:
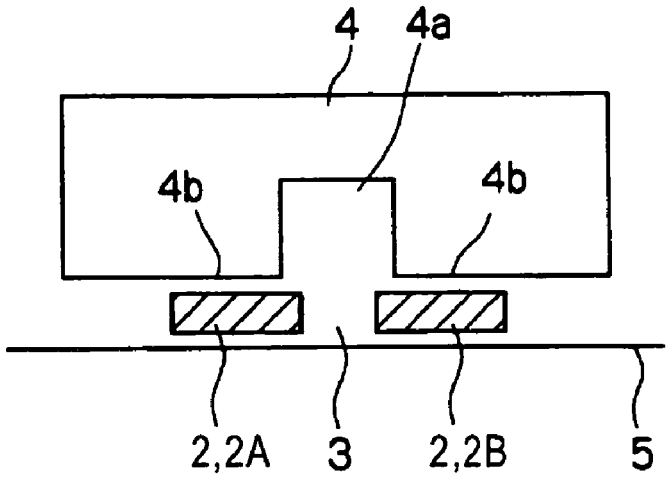
FIG. 23 is a sectional view of FIG. 21 cut along line B—B, and the ink-path member is also shown in FIG. 23.
Figure 24:
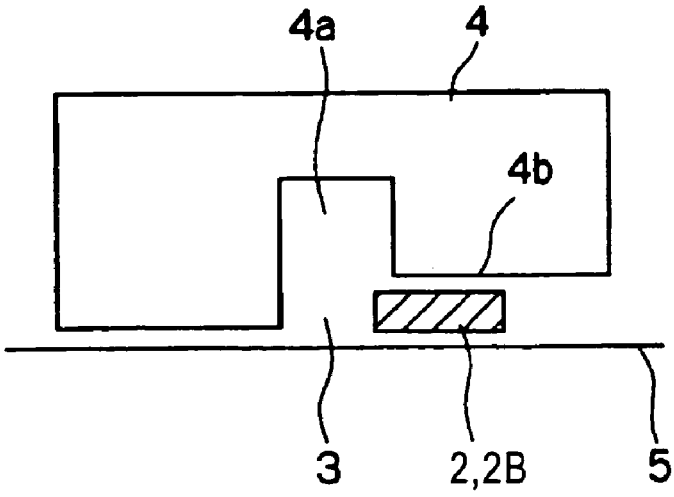
FIG. 24 is a sectional view of FIG. 21 cut along line C—C, and the ink-path member is also shown in FIG. 24.
Figure 25:
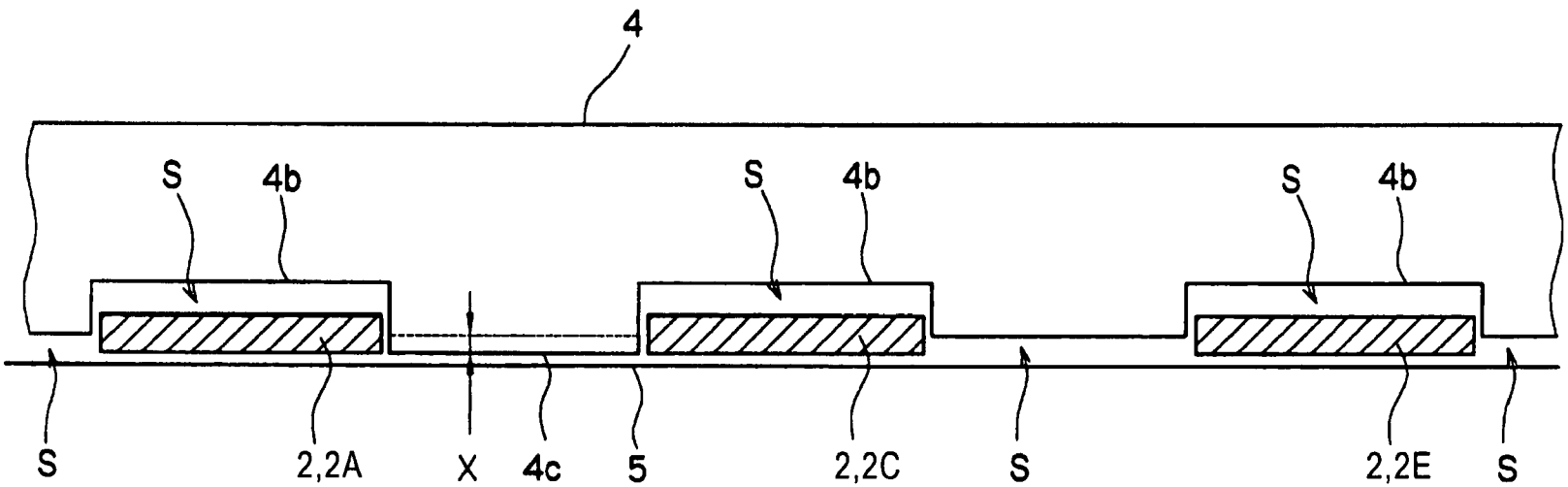
FIG. 25 is a sectional view which corresponds to FIG. 22, showing the case in which the ink-path member includes an error.
Figure 26:
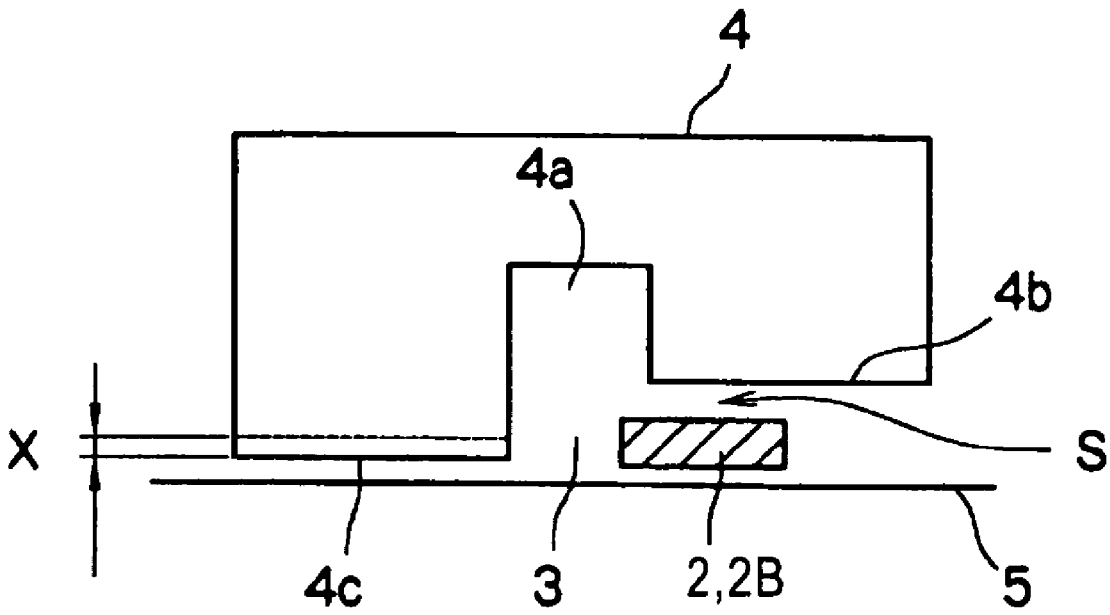
FIG. 26 is a sectional view which corresponds to FIG. 24, showing the case in which the ink-path member includes an error.

FIG. 17 is a plan view showing a print head 40 according to a seventh embodiment of the present invention, which corresponds to FIG. 3 of the first embodiment. FIG. 18 is a sectional view of FIG. 17 cut along line E—E, and an ink-path member 41 is also shown in FIG. 18. FIG. 19 is a sectional view of FIG. 17 cut along line F—F, and the ink-path member 41 is also shown in FIG. 19. FIG. 20 is a sectional view of FIG. 17 cut along line G—G, and the ink-path member 41 is also shown in FIG. 20.

In the seventh embodiment, different from the fourth embodiment, the dummy chips 21 and 22 are not provided. Accordingly, the adhesion surface of the ink-path member 41, which is adhered to the print head chips 11, is not flat. More specifically, as shown in FIG. 18, etc., the ink-path member 41 has recesses 41*c* at positions where the print head chips 11 are disposed. In addition, the recesses 41*c* are not provided and the ink-path member 41 is directly adhered to the nozzle sheet 17 at regions where the print head chips 11 are not disposed. In addition, similar to the third embodiment, projections 41*b* are provided at both ends of the ink-path member 41 in order to close the ends of the ink path 20.

According to the present embodiment, the shape of the ink-path member 41 is more complex than the ink-path member 23, etc., according to the first to sixth embodiments since the recesses 41*c* must be formed at positions corresponding to the print head chips 11. However, in this case, the temperature increase in the print head chips 11 can be suppressed.

Although the embodiments of the second invention of the present application have been described, the present invention is not limited to the above-described embodiments. For example, the following modifications are possible:

(1) It is not necessary that the entire bodies of the ink-path members 34, 39, and 41 be composed of a material having a high thermal conductivity, as long as at least a part of them including portions adhered to the print head chips 11 is composed of a material having a high thermal conductivity, as shown in FIG. 11. The entire bodies of the ink-path members 34, 39, and 41 may of course be composed of a material having a high thermal conductivity.

(2) Although aluminum and an aluminum alloy are mentioned above as examples of materials having a high thermal conductivity used for forming at least a part of the ink-path members 34, 39, and 41, other materials may also be used. With respect to metal materials, the thermal conductivity of a metal material generally increases along with the purity thereof. In addition, metal materials having a high thermal conductivity include Ag, Cu, Au, alloys thereof, and alloys including the above-mentioned metals and other metals. Alternatively, a resin material in which powder of these metals is dispersed may also be used.

According to the present invention, heat generated in the print head chips is rapidly transmitted to the ink-path member, which is disposed on the print head chips and which serves as heat-dissipating means. In addition, the ink-path member, which serves as the heat-dissipating means, is continuously cooled due to the ink flow.

Accordingly, the heat generated in the print head chips is efficiently dissipated without making the structure of the print head chips or the print head complex or increasing the size of-the print head, so that the above-described second object can be achieved.

INDUSTRIAL APPLICABILITY

The present invention relates to print-head manufacturing methods and print heads, and can be applied to, for example, print heads for inkjet printers.

What is claimed is:

1. A print head in which a plurality of ink ejecting print head chips are arranged, each ink ejecting print head chip having a plurality of ink-pressurizing cells, the ink-pressurizing cells having heating elements which are driven so as to eject ink contained in the ink-pressurizing cells through nozzles, the print head comprising:

an ink path which communicates with the ink-pressurizing cells of each ink ejecting print head chip and which is used for supplying ink to the ink-pressurizing cells, wherein the ink ejecting print head chips are alternately disposed on one side and the other side of the ink path along the length of the ink path, and wherein dummy print head chips which do not eject ink are disposed at regions between adjacent ink ejecting print head chips along each side of the ink path.

2. A print head according to claim 1, wherein two ink ejecting print head chips which face each other across the ink path are disposed such that the ends of the print head chips overlap each other by a plurality of nozzles.

3. A print head according to claim 1, wherein the dummy print head chips and the ink ejecting print head chips have a same thickness and top surfaces of the ink ejecting print head chips and the dummy print head chips are even, wherein an ink-path member having a groove which communicates with the ink path is adhered to top surfaces of the ink ejecting print head chips and the dummy chips, and wherein an adhesion surface of the ink-path member which is adhered to the ink ejecting print head chips and the dummy print head chips is flat.

4. A print head according to claim 1, wherein the dummy print head chips do not include heating elements and the ink-pressurizing cells which are provided in the ink ejecting print head chips.

5. A print head according to claim 1, wherein the dummy print head chips are also disposed at both ends of the ink path, and wherein the ink ejecting print head chips and the dummy print head chips are disposed so as to enclose the ink path.

6. A print head in which a plurality of ink ejecting print head chips are arranged, each ink ejecting print head chip having a plurality of ink-pressurizing cells, the ink-pressurizing cells having heating elements which are driven so as to eject ink contained in the ink-pressurizing cells through nozzles, the print head comprising:

an ink path which communicates with the ink-pressurizing cells of each ink ejecting print head chip and which is used for supplying ink to the ink-pressurizing cells, wherein the ink ejecting print head chips are alternately disposed on one side and the other side of the ink path along the length of the ink path, wherein dummy print head chips which do not eject ink are disposed at regions between the ink ejecting print head chips arranged along a side of the ink wherein two ink ejecting print head chips which face each other across the ink path are disposed such that the ends of the ink ejecting print head chips overlap each other by a plurality of nozzles, wherein the dummy print head chips and the ink ejecting print head chips have a same thickness and top surfaces of the ink ejecting print head chips and the dummy print head chips are even, wherein an ink-path member has a groove which communicates with the ink path is adhered to top surfaces of the ink ejecting print head chips and the dummy print head chips, and wherein an adhesion surface of the ink-path member which is adhered to the ink ejecting print head chips and the dummy print head chips is flat.

7. A print head according to claim 6, wherein the dummy print head chips do not include heating elements and ink-pressurizing cells.

8. A print head according to claim 6, wherein the dummy print head chips are also disposed at both ends of the ink path, and wherein the ink ejecting print head chips and the dummy print head chips are disposed so as to enclose the ink path.

9. A print head according to claim 6, wherein the dummy print head chips do not include heating elements and ink-pressurizing cells, wherein the dummy print head chips are also disposed at both ends of the ink path, and wherein the ink ejecting print head chips and the dummy chips are disposed so as to enclose the ink path.

10. A print head in which a plurality of ink ejecting print head chips are arranged, each ink ejecting print head chip having a plurality of ink-pressurizing cells, the ink-pressurizing cells having heating elements which are driven so as to eject ink contained in the ink-pressurizing cells through nozzles, the print head comprising:

an ink path which communicates with the ink-pressurizing cells of each ink ejecting print head chip and which is used for supplying ink to the ink-pressurizing cells, wherein the ink ejecting print head chips are alternately disposed on one side and the other side of the ink path along the length of the ink path, wherein dummy print head chips which do not eject ink are disposed at regions between the adiacent ink ejecting print head chips arranged along a side of the ink path wherein two ink ejecting print head chips which face each other across the ink path are disposed such that the adjacent ends of the print head chips overlap each other by a plurality of nozzles in a direction in which the print head chips are arranged, and wherein the dummy print head chips do not include heating elements and the ink-pressurizing cells.

11. A print head according to claim 10, wherein the dummy print head chips are also disposed at both ends of the ink path, and wherein the ink ejecting print head chips and the dummy chips are disposed so as to enclose the ink path.

12. A print head in which a plurality of ink ejecting print head chips are arranged, each ink ejecting print head chip having a plurality of ink-pressurizing cells, the ink-pressurizing cells having heating elements which are driven so as to eject ink contained in the ink-pressurizing cells through nozzles, the print head comprising:

an ink path which communicates with the ink-pressurizing cells of each ink ejecting print head chip and which is used for supplying ink to the ink-pressurizing cells, wherein the ink ejecting print head chips are alternately disposed on one side and the other side of the ink path along the length of the ink path, wherein dummy print head chips which do not eject ink are disposed at regions between the adjacent ink ejecting print head chips arranged along a side of the ink, wherein two ink ejecting print head chips which face each other across the ink path are disposed such that the adjacent ends of the ink ejecting print head chips overlap each other by a plurality of nozzles, wherein the dummy print head chips are also disposed at both ends of the ink path, and wherein the ink ejecting print head chips and the dummy chips are disposed so as to enclose the ink path.

13. A print head in which a plurality of ink ejecting print head chips are arranged, each ink ejecting print head chip having a plurality of ink-pressurizing cells, the ink-pressurizing cells having heating elements which are driven so as to eject ink contained in the ink-pressurizing cells through nozzles, the print head comprising:

an ink path which communicates with the ink-pressurizing cells of each ink ejecting print head chip and which is used for supplying ink to the ink-pressurizing cells, wherein the ink ejecting print head chips are alternately disposed on one side and the other side of the ink path along the length of the ink path, wherein dummy print head chips which do not eject ink are disposed at regions between the adjacent ink ejecting print head chips arranged along a side of the ink path where the ink ejecting print head chips are not disposed, wherein the dummy print head chips and the ink ejecting print head chips have a same thickness and top surfaces of the ink ejecting print head chips and the dummy print head chips are even, wherein an ink-path member having a groove which communicates with the ink path is adhered to the ink ejecting print head chips and the dummy print head chips, wherein an adhesion surface of the ink-path member which is adhered to the ink ejecting print head chips and the dummy print head chips is flat, and wherein the dummy print head chips do not include the heating elements and the ink-pressurizing cells which are provided in the ink ejecting print head chips.

14. A print head according to claim 13, wherein the dummy pint head chips are also disposed at both ends of the ink path, and wherein the ink ejecting print head chips and the dummy print head chips are disposed so as to enclose the ink path.

15. A print head in which a plurality of ink ejecting print head chips are arranged, each ink ejecting print head chip having a plurality of ink-pressurizing cells, the ink-pressurizing cells having heating elements which are driven so as to eject ink contained in the ink-pressurizing cells through nozzles, the print head comprising:

an ink path which communicates with the ink-pressurizing cells of each ink ejecting print head chip and which is used for supplying ink to the ink-pressurizing cells, wherein the ink ejecting print head chips are alternately disposed on one side and the other side of the ink path along the length of the ink path, wherein dummy print head chips which do not eject ink are disposed at regions between the adjacent ink ejecting print head chips arranged along a side of the ink path wherein the dummy print head chips and the ink ejecting print head chips have a same thickness and top surfaces of the ink ejecting print head chips and the dummy print head chips are even, wherein an ink-path member has a groove which communicates with the ink path and is adhered to the ink ejecting print head chips and the dummy print head chips, wherein an adhesion surface of the ink-path member which is adhered to the ink ejecting print head chips and the dummy print head chips is flat, wherein the dummy pint head chips are also disposed at both ends of the ink path, and wherein the ink ejecting print head chips and the dummy print head chips are disposed so as to enclose the ink path.

16. A print head in which a plurality of ink ejecting print head chips are arranged, each ink ejecting print head chip having a plurality of ink-pressurizing cells, the ink-pressurizing cells having heating elements which are driven so as to eject ink contained in the ink-pressurizing cells through nozzles, the print head comprising:

an ink path which communicates with the ink-pressurizing cells of each ink ejecting print head chip and which is used for supplying ink to the ink-pressurizing cells, wherein the ink ejecting print head chips are alternately disposed on one side and the other side of the ink path along the length of the ink path, wherein dummy print head chips which do not eject ink are disposed at regions between the adjacent ink ejecting print head chips arranged along a side of the ink path, wherein the dummy print head chips are free from the heating elements and the ink-pressurizing cells which are provided in the ink ejecting print head chips, wherein the dummy print head chips are also disposed at both ends of the ink path, and wherein the ink ejecting print head chips and the dummy chips are disposed so as to enclose the ink path.

17. A print head in which a plurality of ink ejecting print head chips are arranged, each ink ejecting print head chip having a plurality of ink-pressurizing cells, the ink-pressurizing cells having heating elements which are driven so as to eject ink contained in the ink-pressurizing cells through nozzles, the print head comprising:

an ink path which communicates with the ink-pressurizing cells of each ink ejecting print head chip, which is used for supplying ink to the ink-pressurizing cells, and which extends in a direction in which the print head chips are arranged; and an ink-path member which has a groove communicating with the ink path and which is adhered to the ink ejecting print head chips so as to cover the ink path, at least a part of the ink-path member which includes portions adhered to the ink ejecting print head chips being composed of a material having a high thermal conductivity, whereby the ink-path member also serves as heat-dissipating means which dissipates heat generated in the ink ejecting print head chips.

18. A print head according to claim 17, wherein at least a part of the ink-path member which includes the portions adhered to the ink ejecting print head chips is comprised of aluminum or a material containing aluminum.

19. A print head in which a plurality of ink ejecting print head chips are arranged, each ink ejecting print head chip having a plurality of ink-pressurizing cells, the ink-pressurizing cells having heating elements which are driven so as to eject ink contained in the ink-pressurizing cells through nozzles, the print head comprising:

an ink path which communicates with the ink-pressurizing cells of each ink ejecting print head chip, which is used for supplying ink to the ink-pressurizing cells, and which extends in a direction in which the ink ejecting print head chips are arranged, wherein the ink ejecting print head chips are alternately disposed on one side and the other side of the ink path along the length of the ink path, wherein dummy print head chips which do not eject ink are disposed at regions between the adjacent ink ejecting print head chips arranged along a side of the ink path, and wherein the print head further comprises an ink-path member which has a groove communicating with the ink path and which is adhered to the ink ejecting print head chips and the dummy print head chips so as to cover the ink path, at least a part of the ink-path member which includes portions adhered to the ink ejecting print head chips and the dummy print head chips being composed of a material having a high thermal conductivity, whereby the ink-path member also serves as heat-dissipating means which dissipates heat generated in the print head chips.

20. A print head according to claim 19, wherein at least a part of the ink-path member which includes the portions adhered to the ink ejecting print head chips and the dummy print head chips is composed of aluminum or a material containing aluminum.

21. A print head according to claim 19, wherein the dummy print head chips and the ink ejecting print head chips have a same thickness and top surfaces of the ink ejecting print head chips and the dummy print head chips are even, and wherein an adhesion surface of the ink-path member which is adhered to the ink ejecting print head chips and the dummy print head chips is flat.

22. A print head according to claim 19, wherein the dummy print head chips are also disposed at both ends of the ink path, and wherein the ink ejecting print head chips and the dummy print head chips are disposed so as to enclose the ink path.

23. A print head according to claim 19, wherein at least a part of the ink-path member which includes the portions adhered to the ink ejecting print head chips and the dummy print head chips is composed of aluminum or a material containing aluminum, wherein the dummy print head chips and the ink ejecting print head chips have a same thickness and top surfaces of the ink ejecting print head chips and the dummy print head chips are even, and wherein an adhesion surface of the ink-path member which is adhered to the ink ejecting print head chips and the dummy print head chips is flat.

24. A print head according to claim 19, wherein at least a part of the ink-path member which includes the portions adhered to the ink ejecting print head chips and the dummy print head chips is composed of aluminum or a material containing aluminum, wherein the dummy print head chips are also disposed at both ends of the ink path, and wherein the ink ejecting print head chips and the dummy print head chips are disposed so as to enclose the ink path.

25. A print head according to claim 19, wherein the dummy chips and the print head chips have the same thickness and top surfaces of the print head chips and the dummy chips are even, wherein an adhesion surface of the ink-path member which is adhered to the ink ejecting print head chips and the dummy print head chips is flat, wherein the dummy print head chips are also disposed at both ends of the ink path, and wherein the ink ejecting print head chips and the dummy print head chips are disposed so as to enclose the ink path.

26. A print head according to claim 19, wherein at least a part of the ink-path member which includes the portions adhered to the ink ejecting print head chips and the dummy print head chips is composed of aluminum or a material containing aluminum, wherein the dummy print head chips and the ink ejecting print head chips have a same thickness and top surfaces of the ink ejecting print head chips and the dummy print head chips are even, wherein an adhesion surface of the ink-path member which is adhered to the ink ejecting print head chips and the dummy print head chips is flat, wherein the dummy print head chips are also disposed at both ends of the ink path, and wherein the ink ejecting print head chips and the dummy print head chips are disposed so as to enclose the ink path.

27. A print head in which a plurality of print head chips are arranged, each print head chip having a plurality of ink-pressurizing cells, the ink-pressurizing cells having heating elements which are driven so as to eject ink contained in the ink-pressurizing cells through nozzles, the print head comprising:

a print-head-chip retainer which retains each of the print head chips; and a nozzle retainer which has the nozzles, wherein the print head chips are disposed on the print-head-chip retainer, wherein the print head chips are disposed such that the ink-pressurizing cells of the print head chips face the nozzles of the nozzle retainer, and wherein at least a part of the print-head-chip retainer includes portions adhered to the print head chips composed of a material having a high thermal conductivity, whereby the print-head-chip retainer also serves as heat-dissipating means which dissipates heat generated in the print head chips.

28. A print head according to claim 27, wherein the print-head-chip retainer has an ink path which communicates with the ink-pressurizing cells of each ink ejecting print head chip and which is used for supplying ink to the ink-pressurizing cells.

* * * * *